US005592769A

United States Patent [19]

Villani

[11] Patent Number: 5,592,769

[45] Date of Patent: Jan. 14, 1997

[54] AUTOMATIC CARTRIDGE MONITORING AND INDICATOR SYSTEM FOR A FIREARM

[76] Inventor: Michael J. Villani, 11 Cumner Rd., Hyannis, Mass. 02601

[21] Appl. No.: 266,943

[22] Filed: Jun. 27, 1994

[51] Int. Cl.[6] ..... F41A 9/62

[52] U.S. Cl. ..... 42/1.02; 42/1.03; 42/50

[58] Field of Search ..... 42/1.01–1.05, 42/70.02, 49.02, 50

[56] References Cited

U.S. PATENT DOCUMENTS

| | | | |
|---|---|---|---|
| 657,918 | 9/1900 | Copping et al. | 42/1.02 |
| 1,252,094 | 1/1918 | de Lempdes . | |
| 1,653,698 | 12/1927 | Coupland . | |
| 2,377,661 | 6/1945 | Baker et al. . | |
| 3,229,399 | 1/1966 | Harvey | 42/1.01 |
| 3,552,053 | 1/1971 | Jarvis . | |
| 4,001,961 | 1/1977 | Johnson et al. . | |
| 4,142,313 | 3/1979 | Musgrave . | |
| 4,216,601 | 8/1980 | Musgrave . | |
| 4,219,953 | 9/1980 | Musgrave . | |
| 4,296,564 | 10/1981 | Oberst | 42/1.04 |
| 4,541,191 | 9/1994 | Morris et al. . | |
| 4,558,626 | 12/1985 | Bartolles . | |
| 4,587,756 | 5/1986 | Jakubaschik et al. . | |
| 4,793,085 | 12/1988 | Surawski et al. | 42/84 |
| 5,005,307 | 4/1991 | Horne et al. . | |
| 5,016,378 | 5/1991 | Sain | 42/70.06 |
| 5,052,138 | 10/1991 | Crain . | |
| 5,113,605 | 5/1992 | Kim | 42/50 |
| 5,142,805 | 9/1992 | Horne et al. | 42/1.02 |
| 5,303,495 | 4/1994 | Harthcock | 42/84 |
| 5,406,730 | 4/1995 | Sayre | 42/1.02 |

OTHER PUBLICATIONS

Advertisement, Tactell Ammo Indicators, Tactell Inc, undated.

Advertisement, B–Square Competition Mounts, undated.

Tasco Propoint, Tasco Sales Inc.

Law 2000, Aro–Tek, Ltd.

*Primary Examiner*—Michael J. Carone

*Assistant Examiner*—Christopher K. Montgomery

*Attorney, Agent, or Firm*—Iandiorio & Teska

[57] ABSTRACT

An automatic cartridge monitoring and indicator system for a firearm includes: a magazine for storing a plurality of cartridges; a follower mechanism in the magazine for feeding the cartridges from the magazine into the firearm; an actuator movable with the follower mechanism; a monitoring device disposed along the path of the follower mechanism and operable by the actuator to monitor the level of the follower mechanism and the level of cartridges in the magazine; and an indicator device responsive to the monitoring device for providing a representation of the level of cartridges in the magazine.

75 Claims, 21 Drawing Sheets

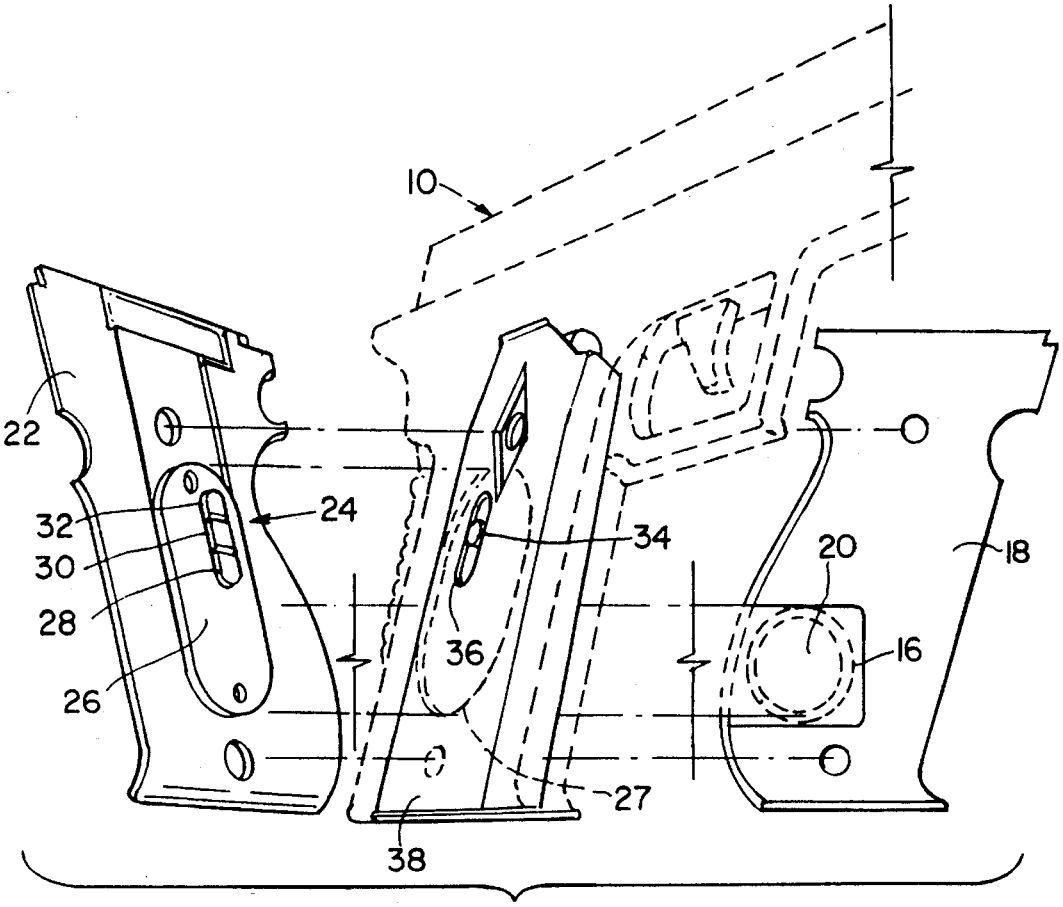
FIG. 6
FIG. 7
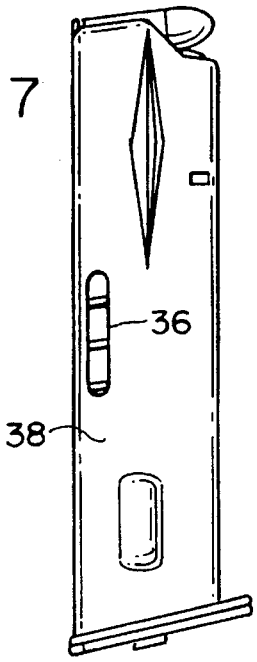
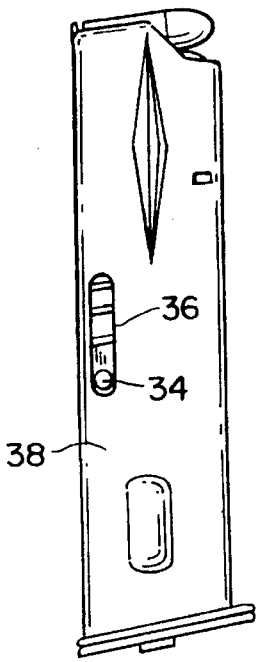
FIG. 8

FIG. 45
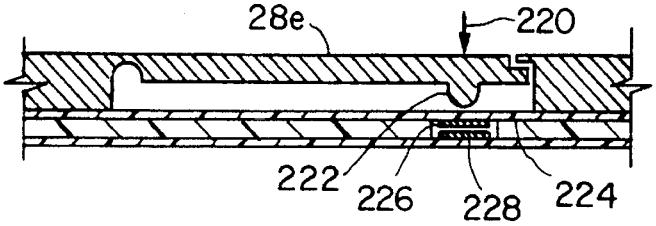
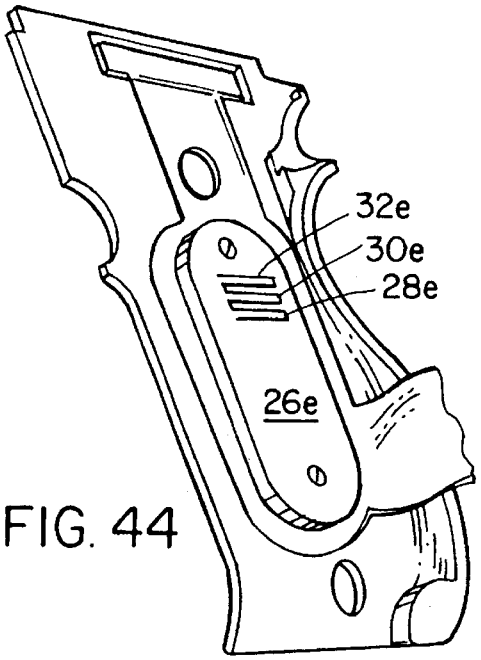
FIG. 44
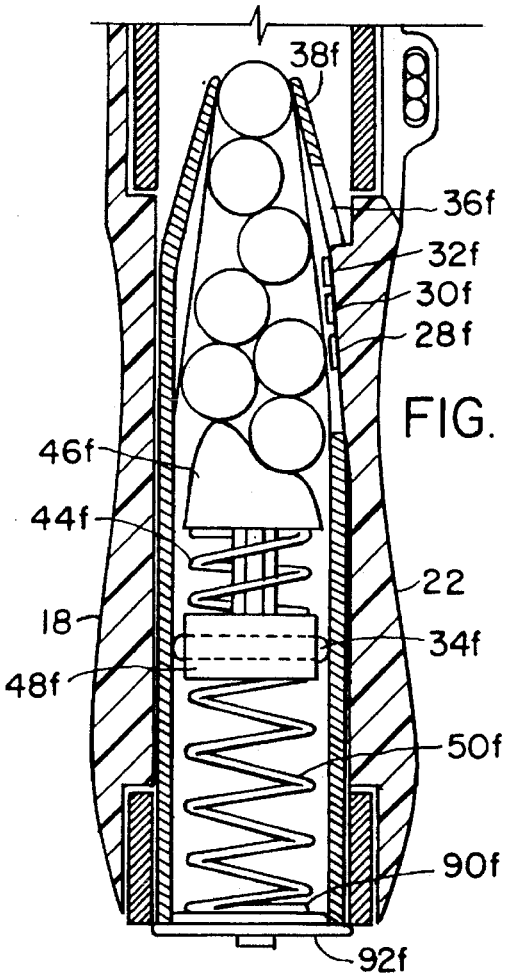
FIG. 46
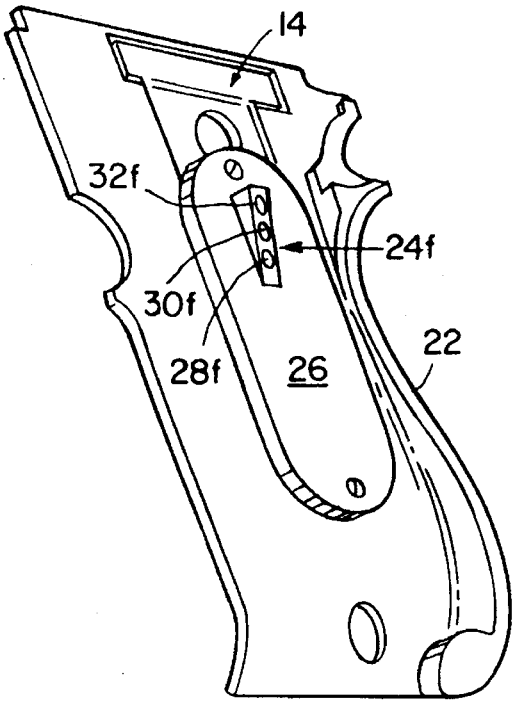
FIG. 47
FIG. 48
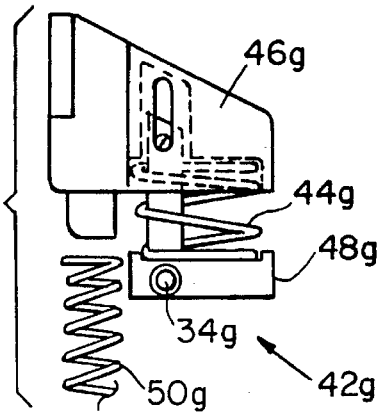

AUTOMATIC CARTRIDGE MONITORING AND INDICATOR SYSTEM FOR A FIREARM

FIELD OF INVENTION

This invention relates to an automatic cartridge monitoring and indicator system for a firearm.

BACKGROUND OF INVENTION

When firing semi-automatic and automatic firearms in law enforcement, military actions and in target shooting competition it is desirable to know when the magazine is about to run out of ammunition. Competition shooters need to know this information so they can be prepared to release the empty magazine and replace it with a full one with minimum loss of shooting time. In police and military operations the need to know is far more serious. Police officers and soldiers can lose their lives in the split second it takes to realize a magazine must be replaced, or an enemy or felon can escape in that time. And studies have shown that under the stress of a firefight it is nearly impossible for the user to keep accurate track of the cartridges fired and those remaining. Prior attempts to monitor the number of cartridges in a magazine by indicating the number expended or the number remaining have met with indifferent success, and by and large applied generally only to pistols and not other firearms. The apparatus often was large and cumbersome and required modifications to each firearm for retrofitting or required redesign for installation with original equipment manufacturers. Such systems did not distinguish between an empty condition and a jammed condition. There were often on-off switches: a real drawback when the user forgets to turn on the system. The prior art designs often relied solely on displaying a count of the number of cartridges spent or remaining, which meant that the shooter had constantly to be watching the display: there was no alarm that communicated urgency. And the brightness of the display was fixed and not adaptable to ambient light conditions or shooters with poorer eyesight. Often the display used an LCD which is not visible in dark or low light conditions, a serious problem in many law enforcement situations. Typically there was no way to test the battery or other power supply or the display to see that the monitoring system was working. The known systems also impeded the free-fall of a released magazine and were not waterproof, a serious shortcoming in police and military applications. And the addition of the monitoring system to the firearm often interfered seriously with the critical ergonomics of the firearm.

SUMMARY OF INVENTION

It is therefore an object of this invention to provide an improved automatic cartridge monitoring and indicator system for a firearm.

It is a further object of this invention to provide such an automatic cartridge monitoring and indicator system which is not limited only to pistols.

It is a further object of this invention to provide such an automatic cartridge monitoring and indicator system for a firearm which is small and compact and can be electrical or mechanical.

It is a further object of this invention to provide such an automatic cartridge monitoring and indicator system for a firearm which can be totally housed within the handle grips and magazine and requires no modification to the firearm.

It is a further object of this invention to provide such an automatic cartridge monitoring and indicator system for a firearm which is easily retrofitted to existing firearms or added to new firearms.

It is a further object of this invention to provide such an automatic cartridge monitoring and indicator system for a firearm which distinguishes between an empty condition and a jammed condition.

It is a further object of this invention to provide such an automatic cartridge monitoring and indicator system for a firearm which is energized without an on-off switch but could have an on-off switch if desired.

It is a further object of this invention to provide such an automatic cartridge monitoring and indicator system for a firearm which can use alarm lights.

It is a further object of this invention to provide such an automatic cartridge monitoring and indicator system for a firearm which when using a visual light display as an indicator of cartridge level, i.e., cartridges spent or remaining, permits for adjustment of the display brightness either manually or automatically in response to ambient light conditions.

It is a further object of this invention to provide such an automatic cartridge monitoring and indicator system for a firearm which is easily tested to determine whether or not the power supply and indicator system are working.

It is a further object of this invention to provide such an automatic cartridge monitoring and indicator system for a firearm in which the magazine quickly and easily is removed in free-fall upon release.

It is a further object of this invention to provide such an automatic cartridge monitoring and indicator system for a firearm which can be made waterproof for police and military applications.

It is a further object of this invention to provide such an automatic cartridge monitoring and indicator system for a firearm which preserves the critical ergonomics of the firearm.

It is a further object of this invention to provide such an automatic cartridge monitoring and indicator system for a firearm which enables the indicator portion of the system to be located on the firearm.

The invention results from the realization that a truly small, compact, accurate and reliable automatic cartridge monitoring and indicator system for a firearm can be effected using an actuator which moves with the magazine follower to operate a switching device along the path of the follower and provides a representation of the level of cartridges in the magazine either by indicating the number spent or the number remaining included in the chamber.

This invention features an automatic cartridge monitoring indicator system for a firearm including a magazine for storing a plurality of cartridges and a follower mechanism in the magazine for feeding the cartridges from the magazine into the firearm. There is an actuator movable with the follower mechanism and a monitoring device disposed along the path of the follower mechanism and operable by the actuator to monitor the level of the follower mechanism and the level of cartridges in the magazine. An indicator device responsive to the monitoring device provides a representation of the level of cartridges in the magazine.

In a preferred embodiment the monitoring device may be an electrical circuit and may include a switching device. The switching device may include at least one switch or it may have a plurality of switches. The switching device may be mounted on the firearm. The magazine may be a cartridge magazine. The actuator may protrude from the magazine to engage the switching device. The magazine may include a recess and the switching device may protrude into the magazine to engage the actuator. The indicator device may be mounted on-the firearm. The indicator device may be electrically connected to the switching device. The indicator device may provide a representation of the number of cartridges remaining in the magazine or the number of cartridges expended from the magazine or the total number in the chamber and magazine or that the last cartridge is in the chamber and the magazine is empty. The representation provided by the indicator device may include a visual display. The visual display may include at least one light or it may be an alphanumeric readout. The magazine may also be a box magazine. The magazine may be tubular.

The follower mechanism may include a follower element and a spring device for urging the follower element to feed the cartridges to the firearm. There may also be an intermediate element spaced from the follower element, a first spring device between the intermediate and follower elements and a second spring device engaged with the side of the intermediate element opposite the first spring device. The first spring device may be designed to open before the second spring device. The follower mechanism may include a limiter device interconnecting the intermediate and follower elements to define the distance by which the elements can be separated by the first spring device. The actuator may be mounted for movement with the intermediate element or with the follower element. The second spring device may include two spring sections, an upper and a lower section, the upper section being smaller in diameter than the lower section.

The firearm may include handle grips and at least one of the grips may include a housing for holding at least a portion of the monitoring circuit. The monitoring circuit may include a power source and the power source may be in the power. The housing source may include a battery. The indicator device may be mounted on the firearm. The firearm may include two handle grips and the display device may be fixed to one of the grips. The light may be energized when there is but one cartridge remaining in the chamber of the firearm.

The visual display may include two lights, the first of which is energized when there is one cartridge left in the chamber of the firearm and the second of which is energized when there is one cartridge in the chamber and one cartridge left in the magazine. The first light may be red and the second light may be yellow. There may be a third light, and the third light may be energized when there is one cartridge in the chamber and two cartridges left in the magazine. The third light may be green. The first light may remain energized even after the last cartridge has been fired. The monitoring circuit may be always enabled or on so that it operates automatically upon the level of cartridges reaching a predetermined level.

The monitoring circuit may include a test switch for energizing the indicator device and demonstrating its operability, and also the condition of the battery. There may be an adjustment device for setting the brightness of at least one light. The adjustment device may sense ambient light level and set the brightness of the light or lights as a function of the ambient light. The light or lights may be implemented by LEDs.

The switching device may include at least one switch element and one operator element responsive to the actuator for operating the switch element. The switch element may include a membrane switch. The firearm may have handle grips and the membrane switch may be mounted in an internal recess in one of the grips. The operator element may be mounted on the inside of the grip and extend through an existing aperture in the handle of the firearm. With a firearm including handle grips, the monitoring circuit may include a power source in one of the grips and a switching device in the other of the grips, and the power source and switching device may be electrically interconnected by a first fiat ribbon conductor disposed within the existing grips. The power source may be housed within the second flat ribbon conductor interconnected with the first flat ribbon conductor.

The display device may be contained in a mounting box and one of the grips may include a recess for receiving the mounting box. The mounting box may be sized for an interference fit with the recess. The switching device may include at least one switch element responsive to the actuator and the switch element may include a membrane switch.

The actuator may be spring loaded and the firearm may include handle grips, and one of the handle grips may include a recess for accommodating extension of the actuator protruding from the magazine for permitting the magazine to move freely in the firearm. There may be a camming surface at the end of the recess for gradually compressing the actuator to facilitate free falling of the magazine. The actuator may have an actuator element extending from each side of the magazine.

The monitoring device may include a switching device which includes at least one switch dement next to each side of the magazine for operation by an associated one of the actuator elements. The actuator elements may be spring loaded and the firearm may include two handle grip, each of which handle grips includes a recess for accommodating extension of the associated actuator element protruding from the magazine for permitting the magazine to move freely, centrally and longitudinally in the firearm, there may be a camming surface at the end of each recess which gradually compresses the actuator elements to facilitate removal of the magazine from the firearm. The switching device may include at least one switch element, each switch element including a pair of spaced conductors, and the actuator may include a conductive contact for bridging the spaced conductors and electrically connecting them to activate the indicator device. The firearm may include two handle grips which are integrally formed as a single unit.

The battery may be mounted internally on a handle grip and extend into an aperture existing in the firearm handle. The firearm may include handle grips and the monitoring circuit may include a power source in one of the grips and the switching device in the other of the grips, and the power source and switching device may be electrically interconnected by conductors in each of the grips and connection pins in one grip that engage sockets in the other. The actuator may include a spring-loaded actuator element and the actuator element may include a cam surface to guide it back into the magazine to facilitate easy loading of cartridges into the magazine. The follower mechanism may include a follower element and an intermediate element spaced from the follower element. There may be a first spring device between the elements and a second spring device engaged with the side of the follower element facing the intermediate element. The system may include a remote data connector responsive to the monitoring device for providing a representation of the condition of the firearm to a remote device.

The firearm may include a magazine release mechanism. The switching device may be biased to enter an aperture in the magazine to engage the actuator and the switching device may include an interconnection device responsive to the release mechanism for overcoming the bias and retracting the switching device from the magazine aperture simultaneously with the operation of the release to enable the magazine to freely fall from the firearm. The indicator device may be mounted on the firearm. The magazine and switching device may be in the handle of the firearm. The firearm may be a pistol. The magazine may be mounted in a receiver and a switching device may be mounted on the receiver and the firearm may be a rifle. The follower mechanism may include two interconnected sections movable relative to each other and the actuator may include at least one actuator element on at least one of the sections of the biasing means for urging apart the sections and urging the actuator element to engage the switching device.

The monitoring device may include a mechanical slider and the indicator device may include a mechanical token connected to a slider driven by an actuator that is operated by the magazine spring or springs. The firearm may include a box that houses at least a portion of the monitoring device that mounts on the outside of the magazine receiver. The box may house the slider and the token. The monitoring device may include biasing means for setting the slider and retracting the token when the magazine is removed. The firearm may include handle grips and at least one of the grips may house at least a portion of the monitoring device. The grip may house the slider and the token.

DISCLOSURE OF PREFERRED EMBODIMENT

Other objects, features and advantages will occur to those skilled in the art from the following description of a preferred embodiment and the accompanying drawings, in which:

FIG. 6 is a view of the firearm of FIG. 1 shown in phantom with the handle grips exploded out, revealing the battery compartment, switching device and actuator in the magazine;

FIG. 7 is a side elevational view of a magazine adapted in accordance with this invention usable in the firearm of FIG. 1 before the actuator becomes visible;

FIG. 8 is a view similar to FIG. 7 after the actuator has become visible;

FIG. 18 is a view similar to FIG. 16 after the last round has been fired, the slide is back, and the red light remains on;

FIG. 44 is a three-dimensional view of a handle grip with an alternative switching device according to this invention;

FIG. 45 is a side elevational view of one of the switch elements of FIG. 44;

FIG. 46 is an elevational sectional view of a portion of the handle of a firearm with the switching device protruding into the magazine;

FIG. 47 is a three-dimensional view of the handle grip of the firearm with the switching device with the protruding switches of FIG. 46;

FIG. 48 is a side elevational view of another follower mechanism according to this invention;

Figure 1:
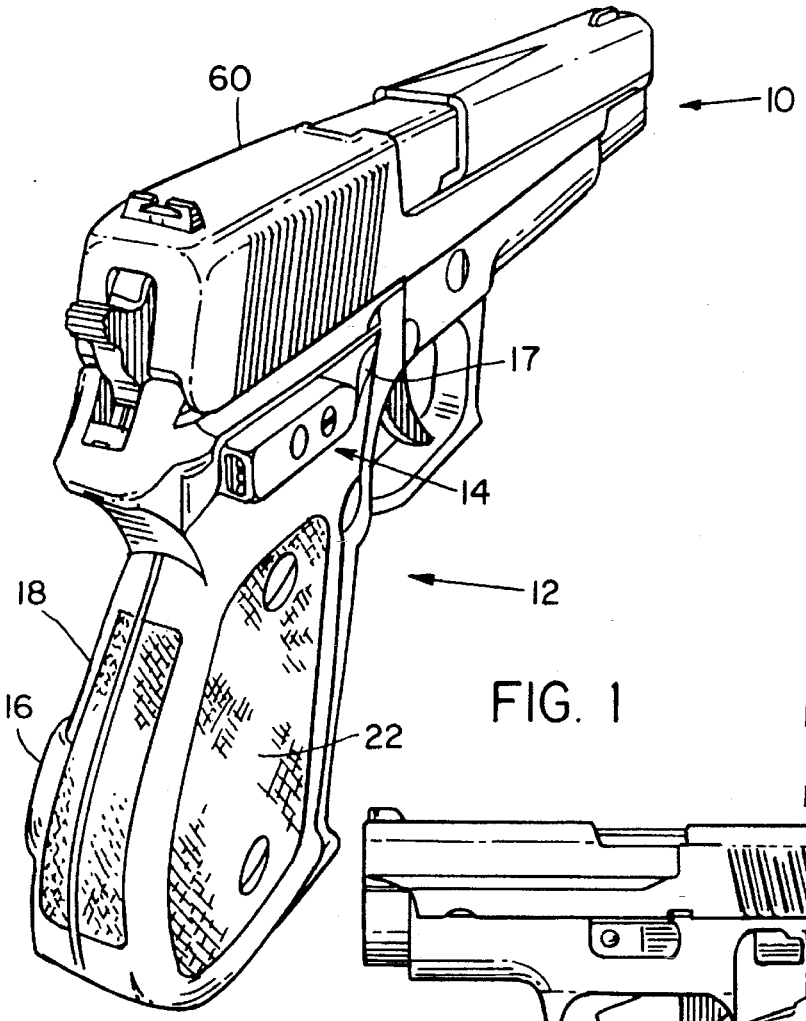
FIG. 1 is a perspective view of a semi-automatic pistol utilizing the automatic cartridge monitoring and indicator system according to this invention.
Figure 2:
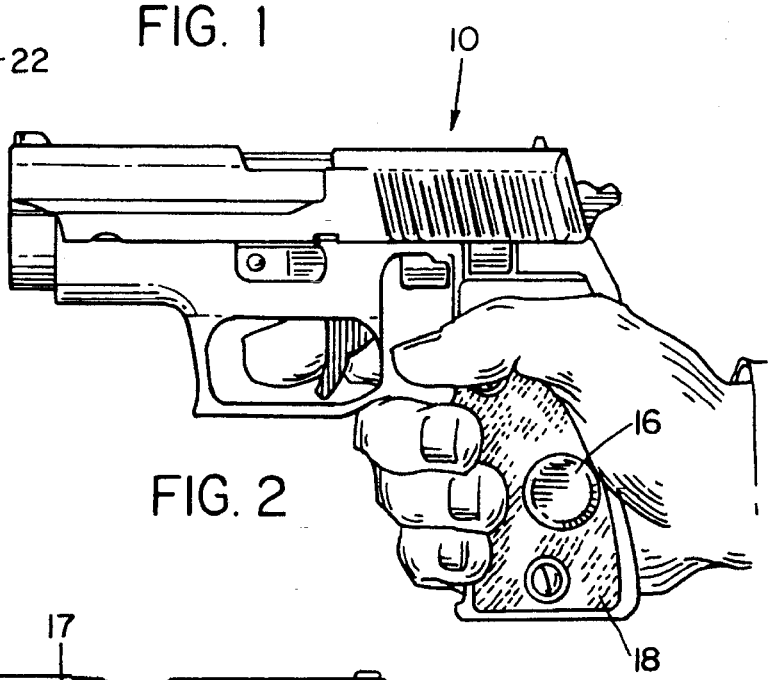
FIG. 2 is a left side view of the firearm of FIG. 1 illustrating the position of the battery compartment.
Figure 3:
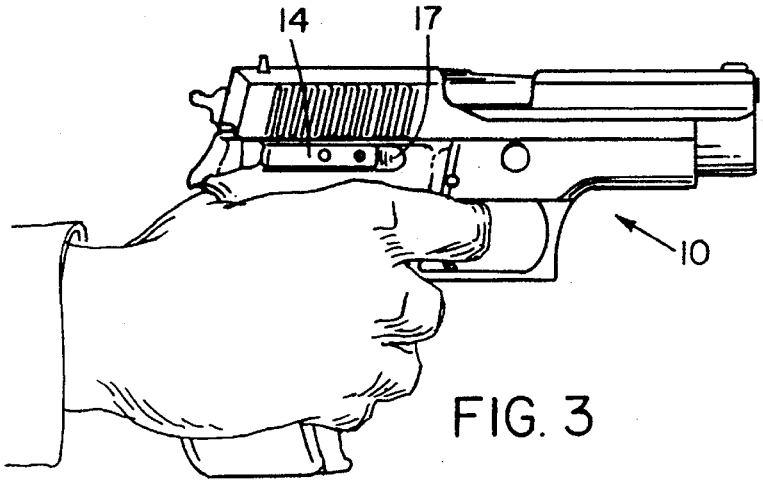
FIG. 3 is right side view of the firearm of FIG. 1 illustrating the position of the indicator device.
Figure 4:
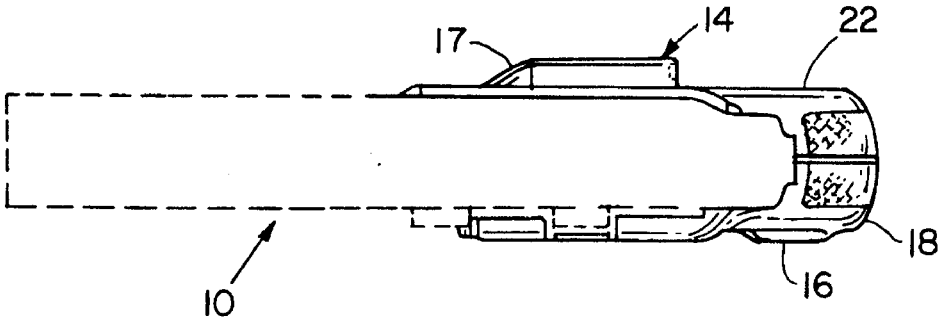
FIG. 4 is a top plan view of a portion of the firearm of FIG. 1 showing both the indicator device and battery compartment.
Figure 5:
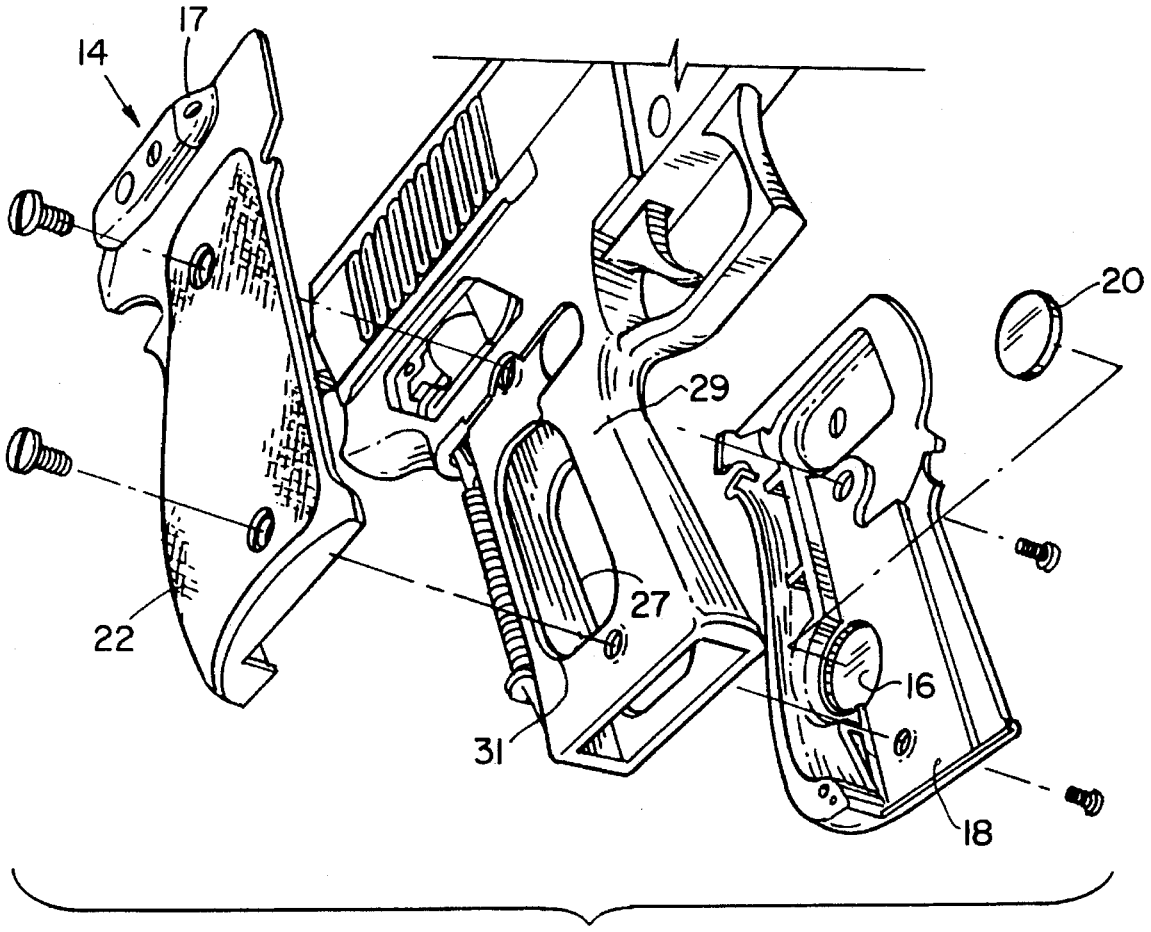
FIG. 5 is an exploded handle portion of the view of the firearm of FIG. 1 with the handle grips exploded out showing the battery compartment.

Throughout the specification and drawings like elements have been given like numbers and similar elements like numbers accompanied by a lower case letter or a prime. There is shown in FIG. 1 firearm 10 including the monitoring and indicator device 12 according this invention including indicator device 14 and battery housing 16 on left handle grip 18. Dummy plug 17 engages and seals (waterproofs) the remote data connector. The small, compact nature of system 12 and its ergonomic elegance can be seen in FIGS. 2 and 3, where the protruding battery housing 16, FIG. 2, and indicator device 14, FIG. 3, are small, unobtrusive, and do not interfere with the hand of the user. The limited bulk of battery housing 16 and indicator device 14 are shown even more dramatically in FIG. 4. Battery 20, FIG. 5, fits inside of battery housing 16 in left handle grip 18. Right handle grip 22, which carries indicator device 14, has its internal portion revealed in FIG. 6, where a switching device 24 can be seen including plate 26 and three switching elements 28, 30 and 32 that are engaged by actuator 34 slidable in slot 36 in magazine 38. Plate 26 is received in aperture 27, FIG. 5, of frame handle or receiver frame 29 and is flush with the interior magazine chamber wall 31. Actuator 34 does not appear in slot 36, FIG. 7, until there are only a predetermined number of cartridges spent or, conversely, there are a predetermined number of cartridges remaining. When that point occurs, actuator 34, FIG. 8, appears at the low end of slot 36.

Figure 9:
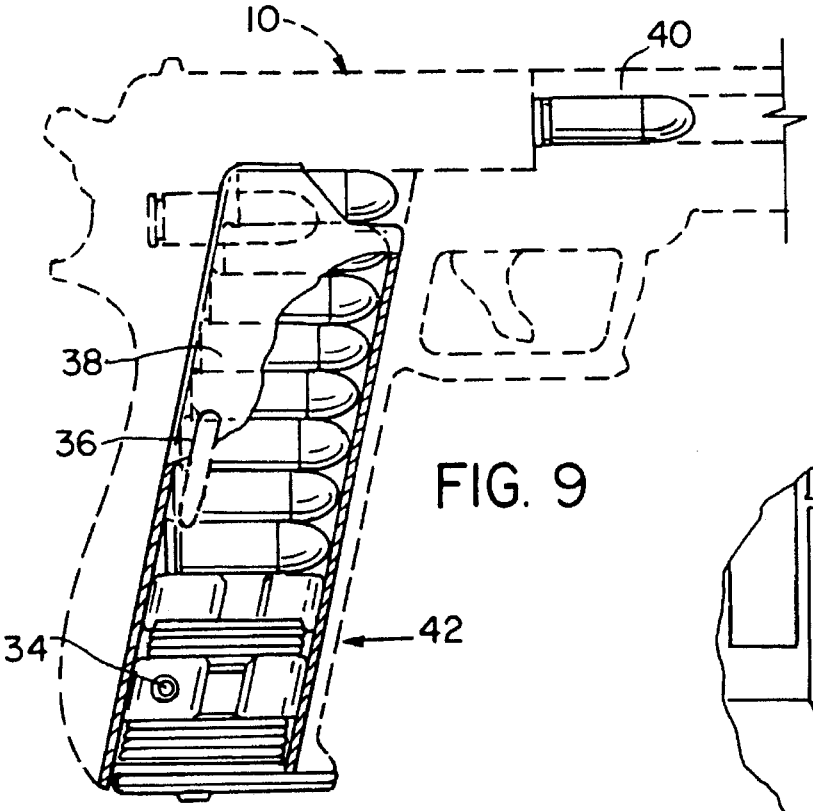
FIG. 9 is a side elevational view, with the firearm shown in phantom, of a loaded magazine with a fully compressed follower mechanism.
Figure 10:
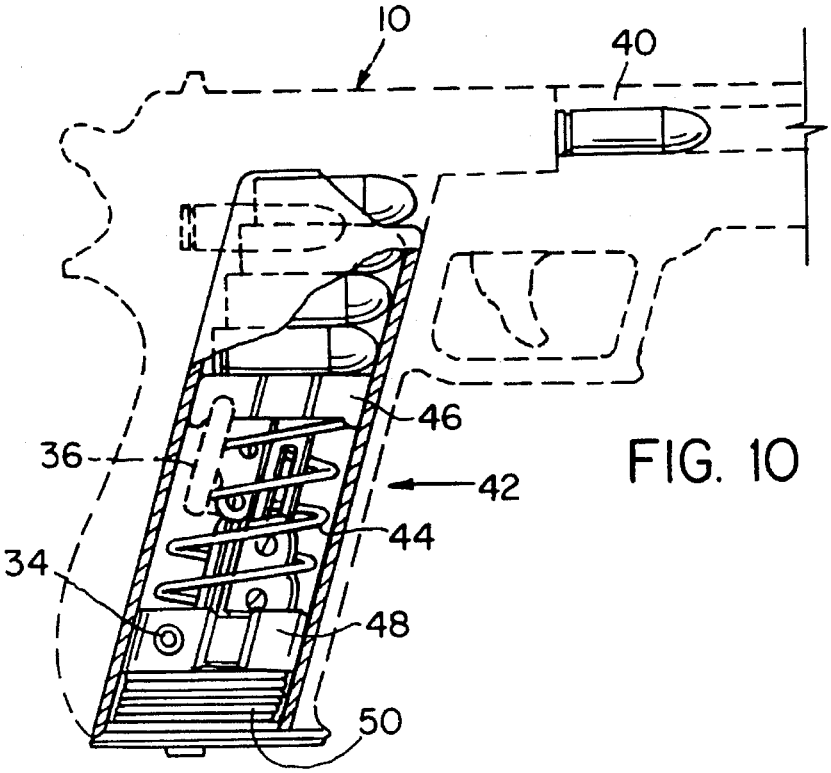
FIG. 10 is a view similar to FIG. 9 with the magazine with five cartridges remaining and the follower mechanism extended.

When firearm 10 is fully loaded, FIG. 9, with, for example, fifteen cartridges in doublestack magazine 38 and one in the chamber 40, follower mechanism 42 is fully compressed. As firing commences and cartridges are expended, the upper, stronger spring 44, FIG. 10, separates follower element 46 from follower intermediate element 48 while the lower, weaker spring 50 remains compressed. Since the upper spring 44 is stronger it fully extends before spring 50 begins to extend, thereby firmly and early setting the distance from follower element 46 to intermediate element 48, enabling accurate measuring of the cartridge level.

Figure 11:
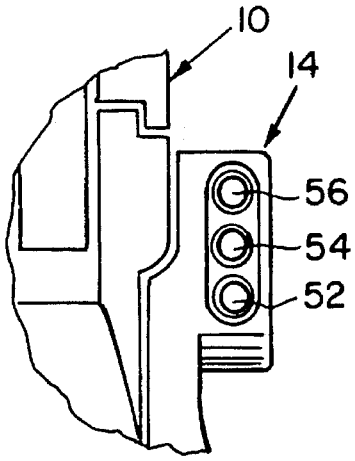
FIG. 11 is an enlarged view of the display device in the black condition where none of the indicator alarm lights are energized.

At this point the three display lights 52, 54 and 56, FIG. 11, which may for example be different colors such as green, yellow and red, respectively, are dark, and this is known as the black condition. The red light stays on even after the last cartridge is fired, indicating an empty condition. If the firearm fails to fire and the red light is not energized that indicates a jam or other malfunction. In this particular embodiment three lights are used, but one or any number may be used, and also in this embodiment three lights are used to indicate three, two and one cartridges left, but this too is not a necessary limitation of the invention. In addition, although throughout this specification the indicator device is shown as a visual display, this is not a necessary limitation of the invention as other types of signalling, such as sound, infrared for night vision security, or other means could be used. And various types of visual displays may be used, e.g., symbols, lights, alphanumeric characters.

Figure 12:
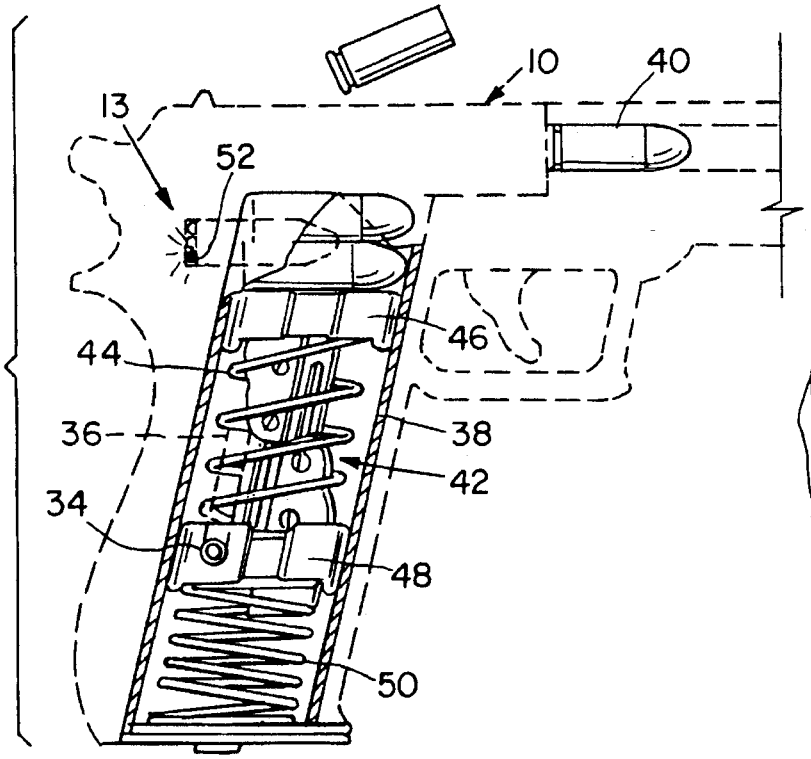
FIG. 12 is a view similar to FIG. 10 in which the second spring of the follower mechanism is extended, there are three cartridges remaining, one in the chamber of the firearm and two in the magazine and the first of three lights, a green one, is lit.
Figure 13:
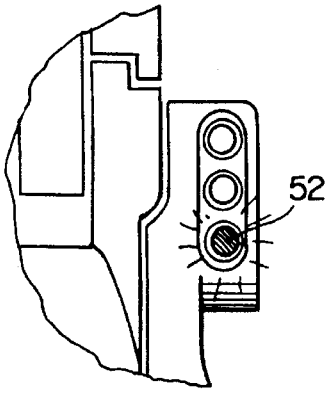
FIG. 13 is an enlarged end view showing the lighted green light.
Figure 15:
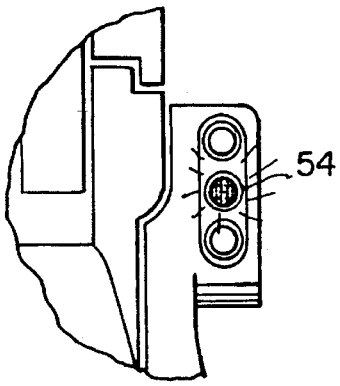
FIG. 15 is a view similar to FIG. 13 showing the lit second, yellow light.
Figure 14:
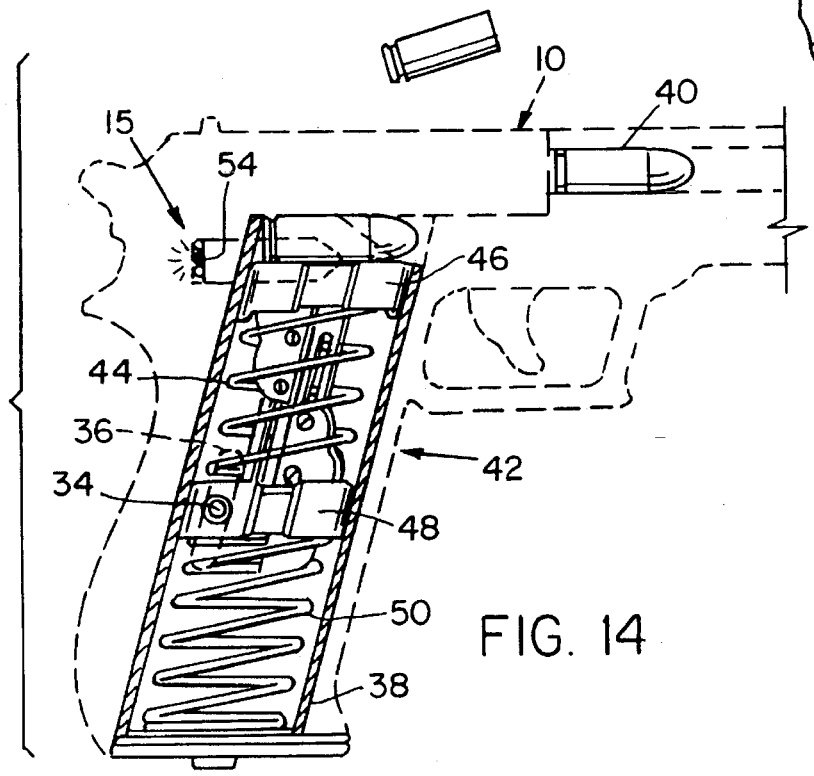
FIG. 14 is a view similar to FIG. 12 with one cartridge in the firearm chamber and one in the magazine, with the second, yellow light, lit.
Figure 16:
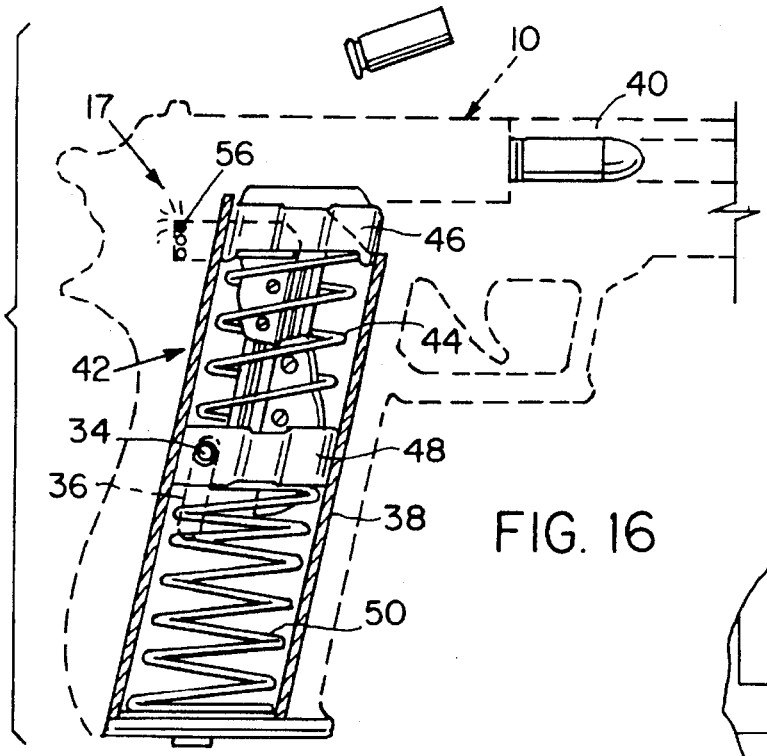
FIG. 16 is a view similar to FIGS. 12 and 14 with both springs of the follower mechanism extended, only one cartridge left in the firearm chamber, and the third, red light lit.
Figure 17:
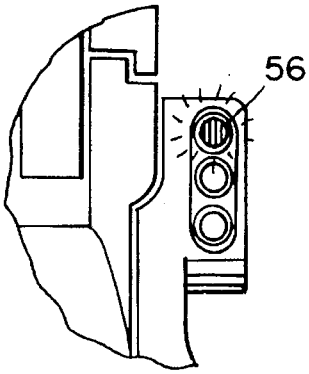
FIG. 17 is a view similar to FIG. 15 showing the third, red, light lit indicating that the firearm is out of ammunition.
Figure 18:
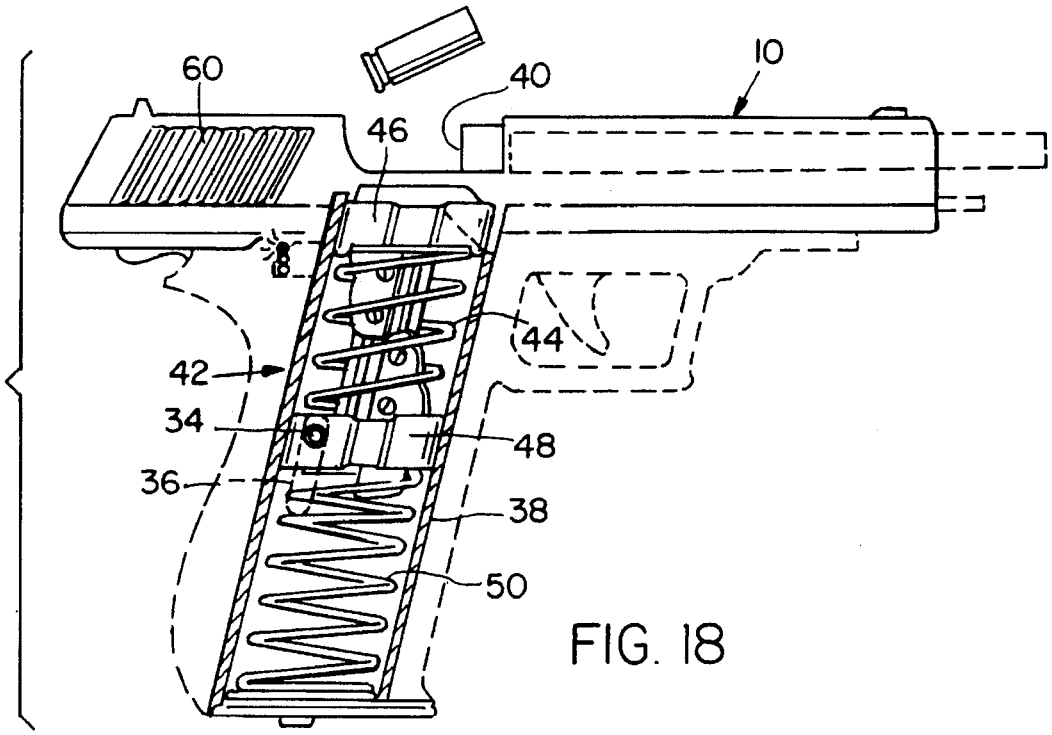

As firing progresses from this point, there will eventually occur the situation where there is one cartridge in chamber 40 of firearm 10 and two in magazine 38, FIG. 12. At this point in this embodiment lower spring 50 has begun to uncoil and actuator 34 has engaged the first switch 28, FIG. 6, so that the green light 52, FIG. 13, comes on indicating that there are three cartridges left, two in the magazine and one in the chamber. As lower spring 50 uncoils it pushes follower element 42 upwards to continue feeding cartridges. Follower element 42 stays completely open while under pressure from lower spring 50 throughout feed of cartridges from magazine 38. When that round is fired and there is but one left in the chamber and one in the magazine, FIG. 14, the second, yellow, light 54, FIG. 15, is energized. Following this, when there is but one cartridge left in chamber 40, FIG. 16, the third and last, red, light 56, FIG. 17, is energized. After this, even though there are no more cartridges to be fired, the red light stays on as long as an empty magazine is in place, and with the slide 60 locked back to indicate an empty firearm, as in FIG. 18. When the shooter releases the empty magazine 38, FIG. 18, from the firearm, the switch opens and deenergizes the red light. The system will then reset itself when a fresh magazine with an adequate supply of ammunition is inserted into the firearm.

Figure 19:
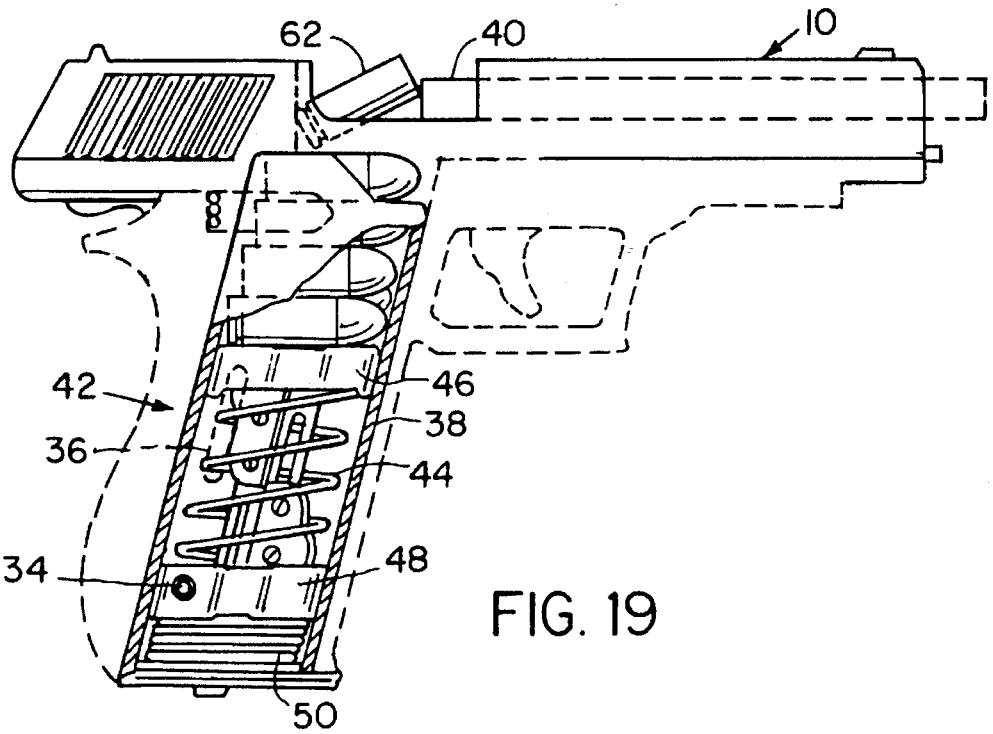
FIG. 19 is a view similar to FIG. 10 in which a cartridge has become caught in the mechanism so that the gun will not fire and the indicator is in the black condition with no lights lit, indicating a jammed condition.

The system has the added advantage of indicating when the firearm is not functioning because of a malfunction and not because of a lack of ammunition. For example, when a spent cartridge casing 62, FIG. 19, is jammed in chamber 40, and there is ample ammunition in magazine 38, no red light energized 56, FIG. 17, since the actuator is not at a level where it can engage the last switch 32, FIG. 6.

Figure 20:
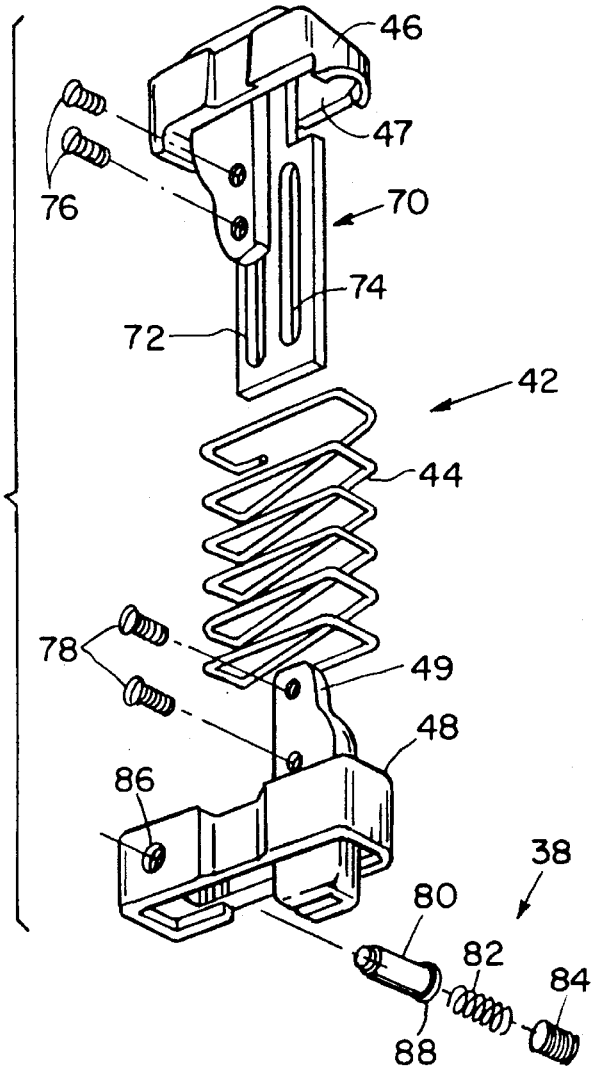
FIG. 20 is an exploded three-dimensional view of a two-part follower mechanism with actuator according to this invention.
Figure 22:
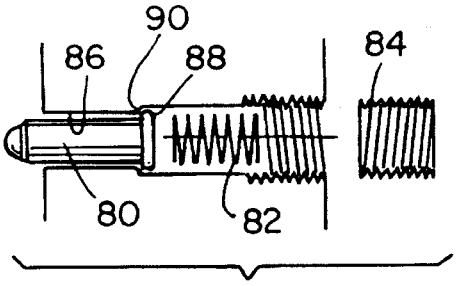
FIG. 22 is a side sectional elevational view of a portion of the intermediate element of the follower mechanism of FIG. 20 showing the installation of the actuator.
Figure 21:
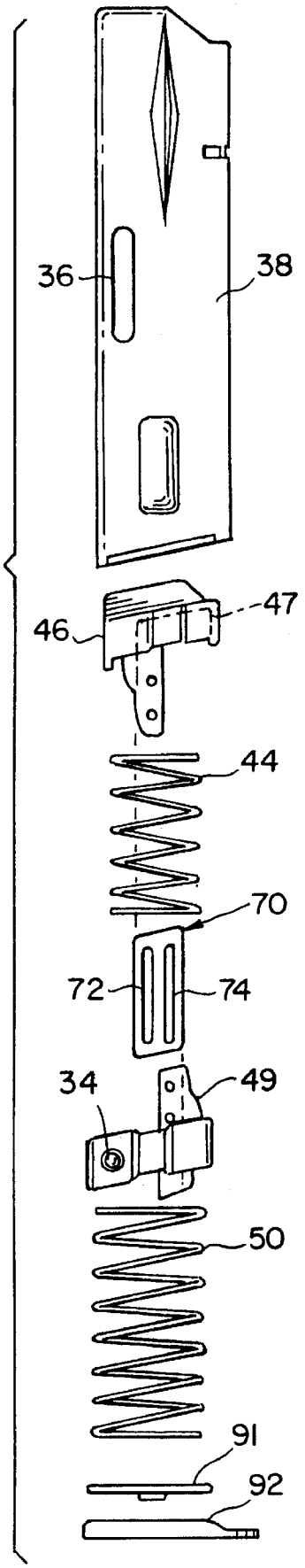
FIG. 21 is an exploded three-dimensional side view of the two-part follower mechanism of FIG. 20 with the magazine and springs.

Follower mechanism 42 is shown in greater detail in FIG. 20 along with single-ended actuator, where it can be seen that follower dement 46 is interconnected with intermediate element 48 by means of limiter 70 which includes two slots 72 and 74, that enable elements 46 and 48 to move toward and away from each other to the limit allowed by limiter 70. Cavity 47, FIG. 20, inside follower element 46 accepts the top of post 49, FIG. 20, and the top of limiter 70 when follower element 42 is compressed. Screws 76 and nuts (not shown) mount limiter 70 through slot 72 to follower element 46 while screws 78 and nuts (not shown) mount limiter 70 through slot 74 to intermediate element 48. In this way spring 44 is enabled to urge apart elements 46 and 48 only to the limit allowed by limiter 70. Actuator 38 includes a single actuator element 80 urged outward by spring 82 mounted against threaded base 84, all of which fit in bore 86 in intermediate element 48, as can be seen more clearly in FIG. 22, wherein the rear flange 88 of actuator element 80 acts to retain it in bore 86 against shoulder 90. Lower, weaker spring 50 nests in the bottom of intermediate element 48 and rests on lock plate 91, FIG. 21, on the floor plate 92 of magazine 38.

Figure 23:
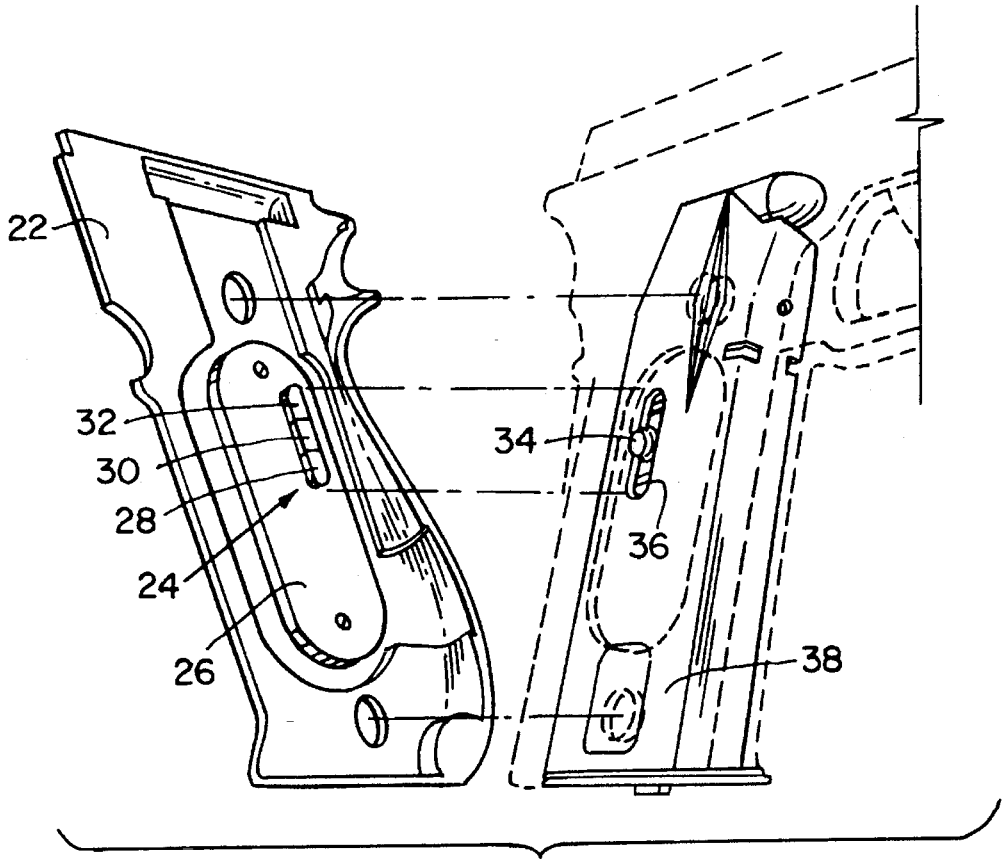
FIG. 23 is an exploded three-dimensional view showing a switching device mounted in the handle grip and the actuator protruding from an aperture in the magazine.
Figure 25:
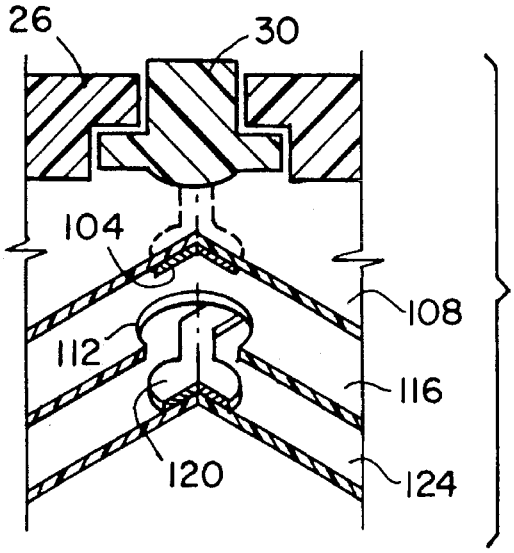
FIG. 25 is an enlarged detailed view of one operator and its associated membrane switch.
Figure 24:
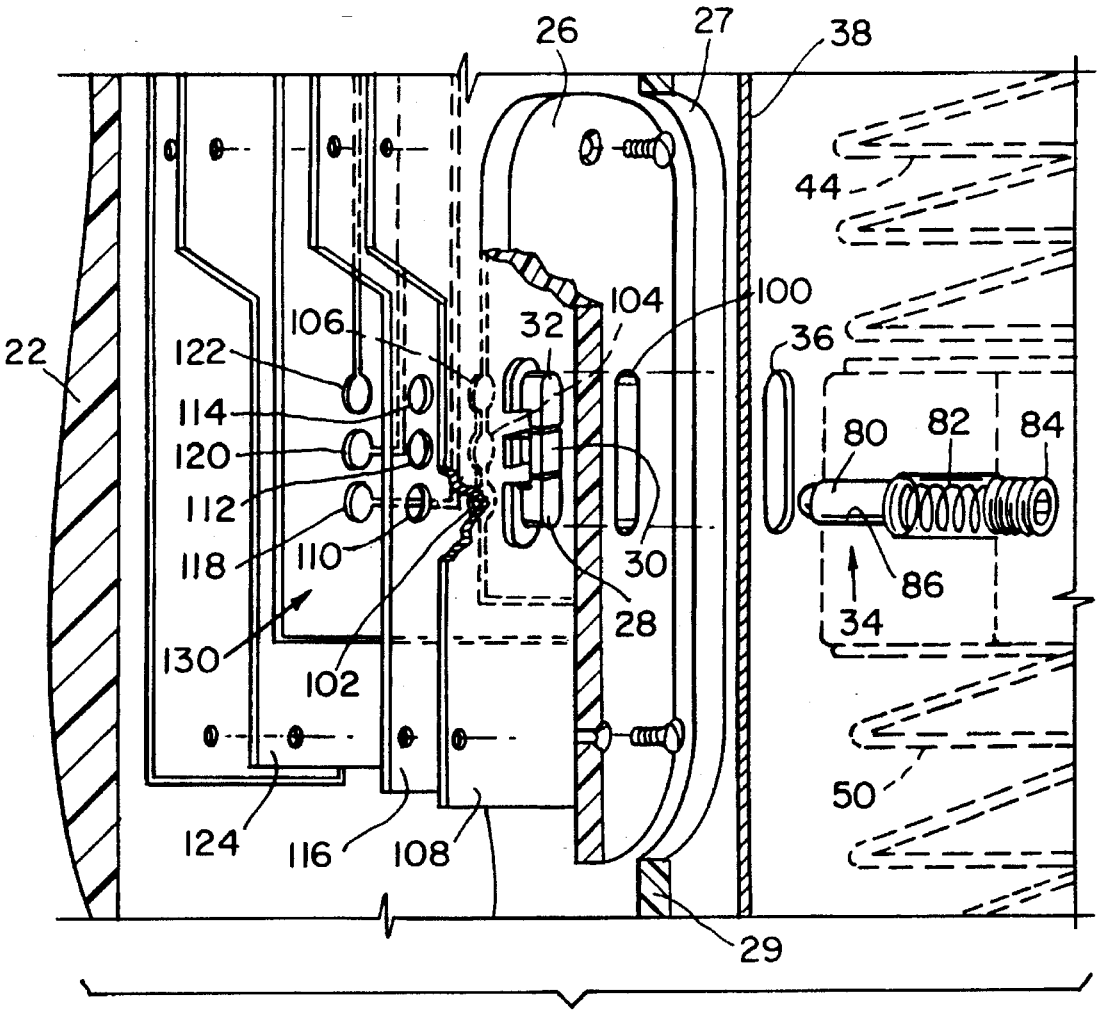
FIG. 24 is an enlarged exploded view of the switching device and actuator with portions broken away.

Actuator 34, FIG. 23, protrudes from slot 36 in magazine 38 to engage switching device 24 which includes the three operator members 28, 30 and 32 mounted on grip 22 by plate 26. The three operator elements 28, 30 and 32 extend through slot 100, FIG. 24, which aligns with slot 36 in magazine 38. The pressure of actuator 34 on each one of operators 28, 30 and 32 causes them to engage, respectively, contacts 102, 104 and 106, FIG. 24, on sheet 108 through holes 110, 112 and 114 in sheet 116 to engage contacts 118, 120 and 122 on sheet 124 which constitute a membrane. These are known as membrane switches, one of which is shown in greater detail in FIG. 25, where portions have been cut away for clarity. The membrane construction may also be used to house the battery, but one integral membrane can house the battery electrically interconnected with the switching device, and also house the switching device itself as shown with respect to FIGS. 24 and 25.

Figure 26:
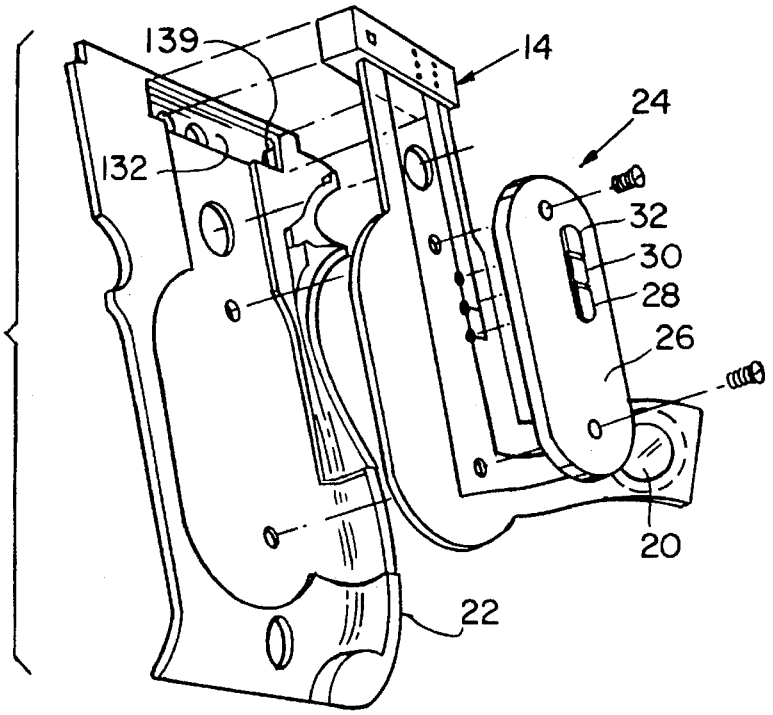
FIG. 26 is an exploded view showing a handle grip with the switching device and the indicator device.
Figure 27:
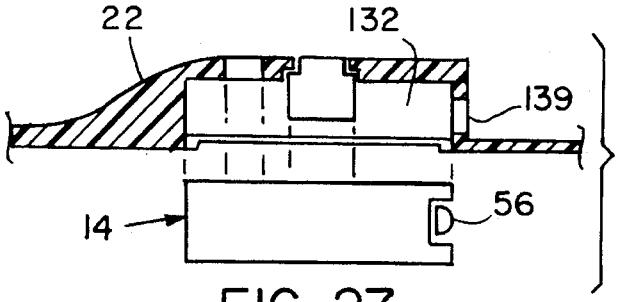
FIG. 27 is a top plan view showing the fit of the indicator device in the handle grip.
Figure 28:
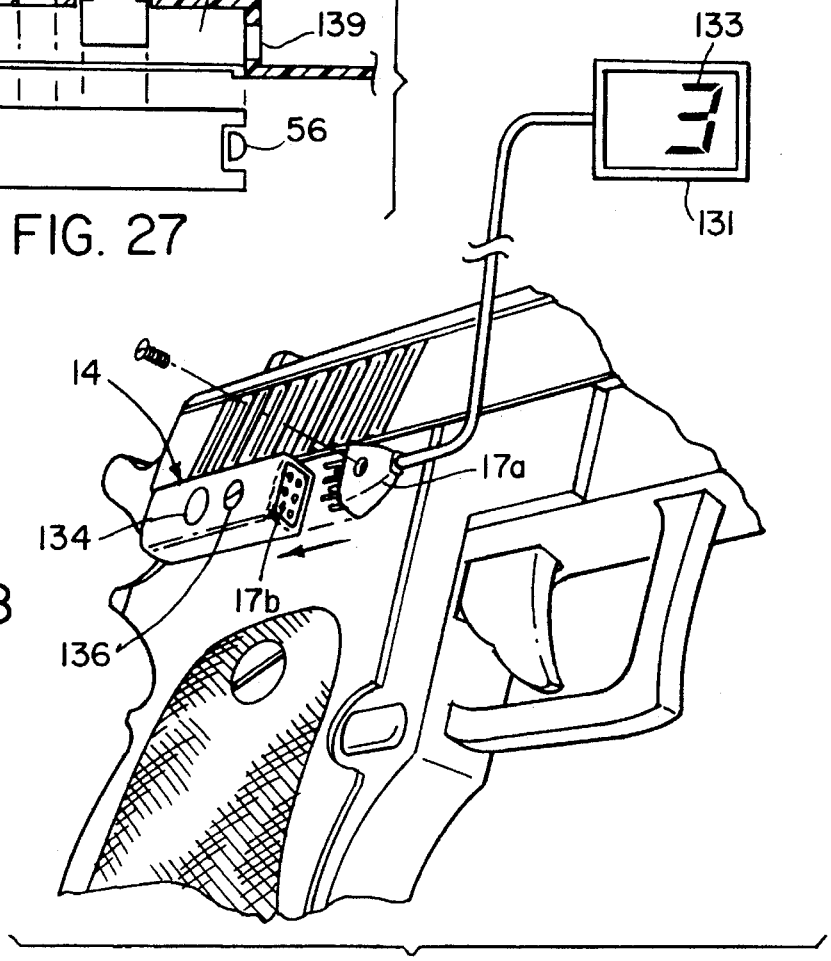
FIG. 28 is an enlarged three-dimensional view of the indicator device, the test button, brightness adjustment, and remote data connector.

The entire monitoring and indicator system according to this invention is installable on most firearms without any alterations or modifications to the firearm itself. Other firearms may require some alteration. All of the required circuitry and components may be mounted on a pair of handle grips which can replace the original equipment handle grips. The membrane 130, FIG. 24, which employs sheets 108, 116 and 124 and the attendant elements, may now be extended to hold battery 20 and may also be used to interconnect them with indicator device 14, FIG. 26. The indicator device fits snugly into recess 132 in handle grip 22, as can be seen more clearly in FIG. 27 and light 56 when energized can be seen through slot 139 in handle 22, FIGS. 26, 27. A test button 134, FIG. 28, and brightness adjustment device 136, FIG. 28, are mounted on the side of indicator device 14. The brightness adjustment 136 may be either a small potentiometer or variable resistor or it may be a photoresistor which is sensitive to ambient light conditions so that the brightness is automatically controlled. In FIG. 28 sealing plug 17, FIG. 1, has been removed and remote data connector **17*a* has been inserted in its place in receptacle 17*b* to deliver data to another remote device which may be a display device or an electronic circuit or digital processor 131 for further collecting, analyzing and/or recording or displaying the information such as in alphanumeric form 133**.

Figure 29:
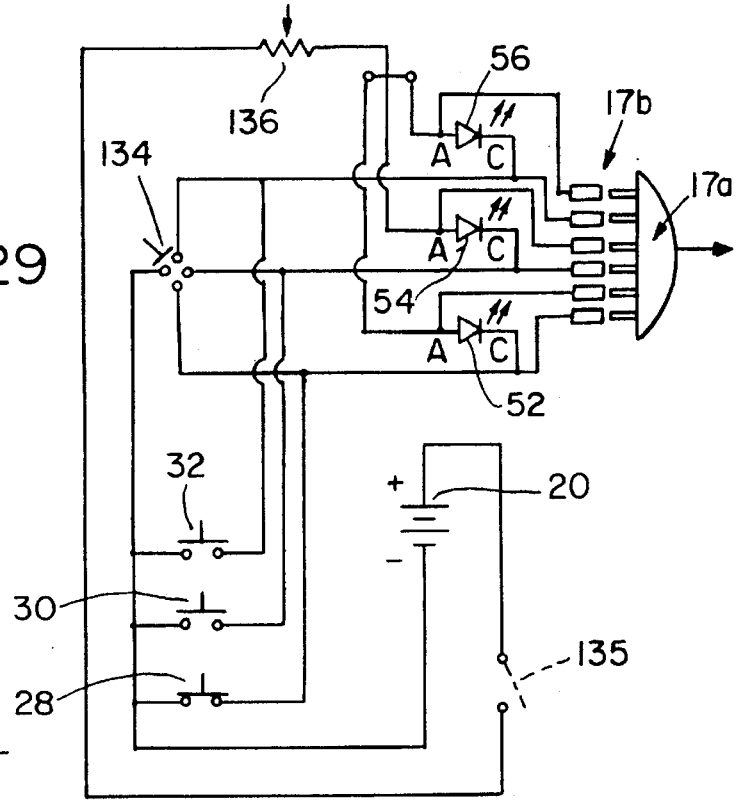
FIG. 29 is an electrical schematic diagram of the switching device alarm lights, battery, brightness adjustment, test button, and remote data connector.
Figure 30:
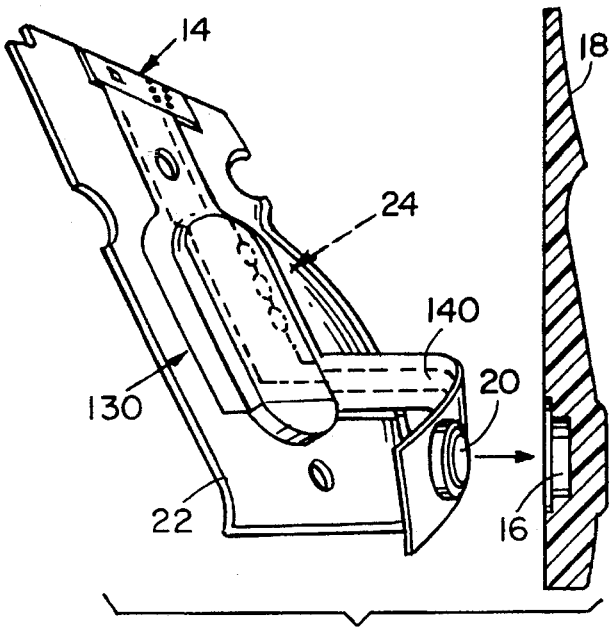
FIG. 30 is a three-dimensional view of the handles with portions in section showing the membrane interconnecting the indicator device and switching device on one handle grip and wrapping around the handle to connect with the battery in the other handle grip.

Test button 134, FIG. 29, connects battery 20 to each of the lights 52, 54 and 56 such as implemented by LEDs so that the battery and the lights can both be checked. A conventional on-off switch 135 can be employed if desired. Photoresistor or variable resistor 136 directly controls the current flow to each of the LEDs to set the brightness. Switch 28 is shown closed while switch elements 30 and 32 are shown open. The use of the single continuous membrane 130 to interconnect indicator device 14, switching device 24 and battery 20 is shown to advantage in FIG. 30, where battery housing 16 and handle grip 18 readily receive battery 20 in membrane 130. While the remaining portion of the membrane 140 wraps around between handle grips 18 and 22 and extends beyond switching device 24 to indicator device 14. Since there is no on-off switch the system is on whenever actuator 34 engages any of switches 28, 30, 32.

Figure 31:
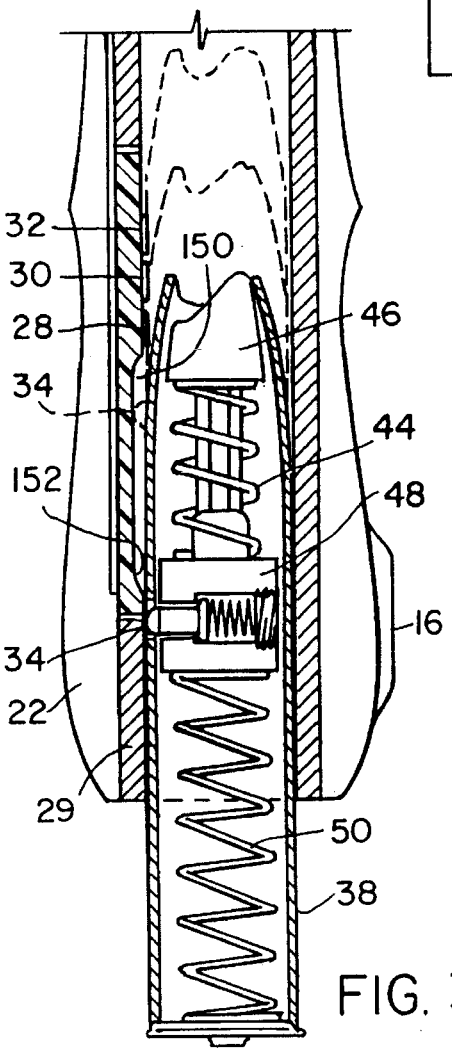
FIG. 31 is a sectional view of the handle of the firearm showing a camming recess for facilitating free-fall release of the magazine.

In order to facilitate free-fall easy release of magazine 38, FIG. 31, a camming recess 150, FIG. 31, may be provided on the inside of handle grip 22 so that when the magazine is released and begins to drop out, actuator 34 protruding from slot 36 first has room to be in its extended position without forcefully contacting the wall so that magazine 38 can fall freely. By the time actuator 34 reaches the lower curved camming surface 152 there is enough energy for the actuator to be gently cammed inwardly by the receiver frame 29 without interfering with the free-fall release of magazine 38.

Figure 32:
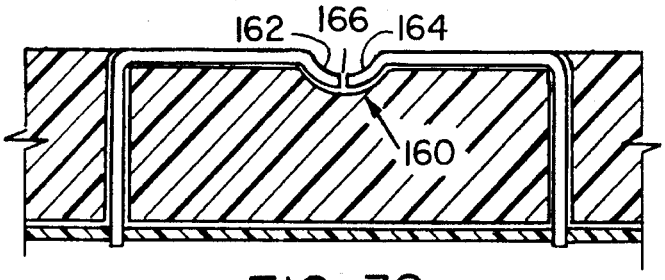
FIG. 32 is a side sectional view of another type of switching element according to this invention.
Figure 33:
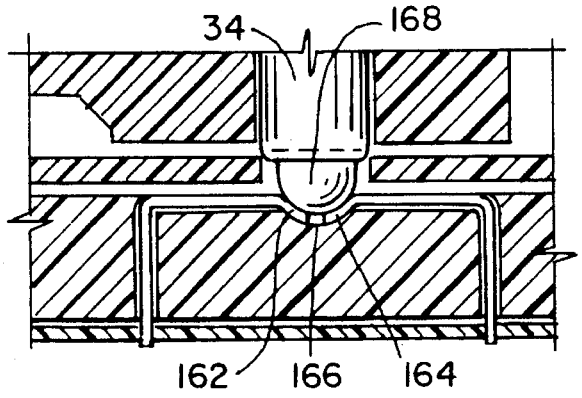
FIG. 33 is a view similar to FIG. 32 with the addition of the actuator positioned to short or close the switch element.
Figure 34:
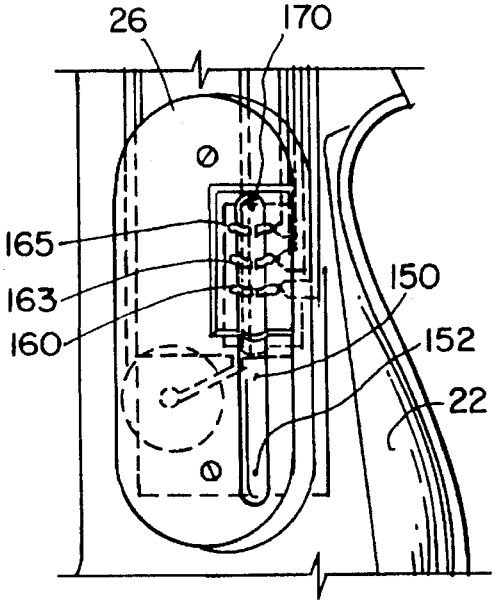
FIG. 34 is an elevational plan view of the switching device showing a gang of three switches as shown in FIGS. 32 and 33.

Another simpler type of switch element 160, FIG. 32, useful in this invention, includes simply two conductors 162 and 164 with a small space 166 between them. When the conductive tip 168, FIG. 33, of actuator 34 bridges gap 166, it shorts or connects conductors 162 and 164 to each other, thereby closing the switch. Three such switches 160, 163 and 165, FIG. 34, installed at groove 170 of plate 26 are actuated by the tip 168 of actuator 34 as it moves along in groove 170 with the follower element or intermediate element or some other part of the follower mechanism. The switch construction in FIG. 34 permits much higher packing density to be more compatible with smaller systems such as used with 22 caliber ammunition.

Figure 35:
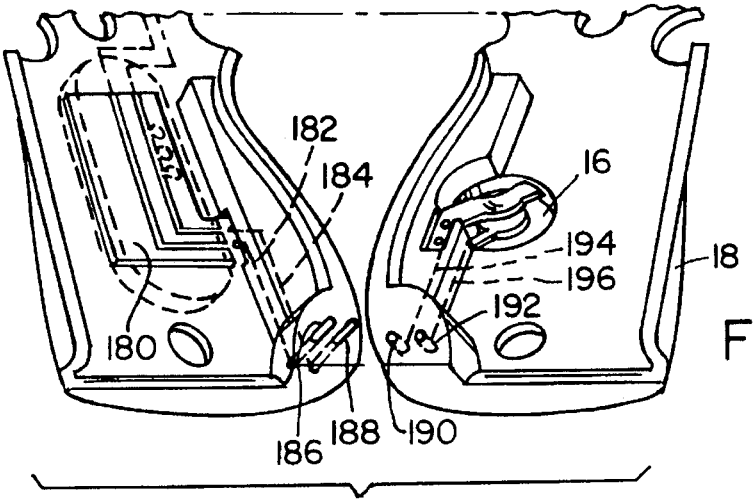
FIG. 35 is an axonometric view of two handle grips showing an alternative electrical interconnection between the grips.
Figure 38:
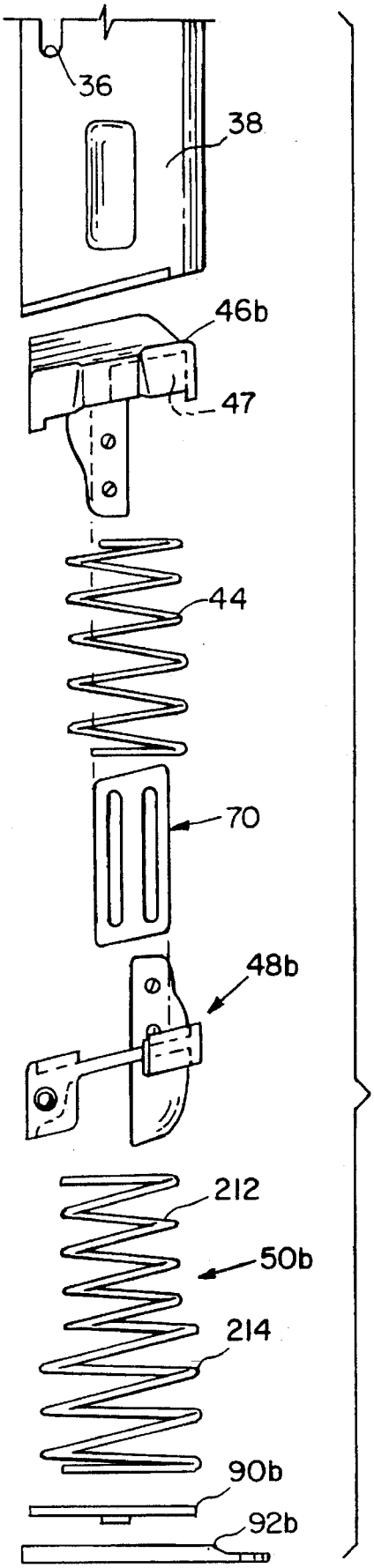
FIG. 38 is an exploded elevational view showing the magazine and complete follower mechanism using the intermediate element of FIG. 37.

In some constructions printed circuit boards 180, FIG. 35, may be desirable instead of the membrane construction. In that case, conductive paths between the battery in handle grip 18 and the other portions of the monitoring and indicator device may be made via conductors 182, 184, pins 186 and 188, sockets 190 and 192, and conductors 194 and 196.

Figure 36:
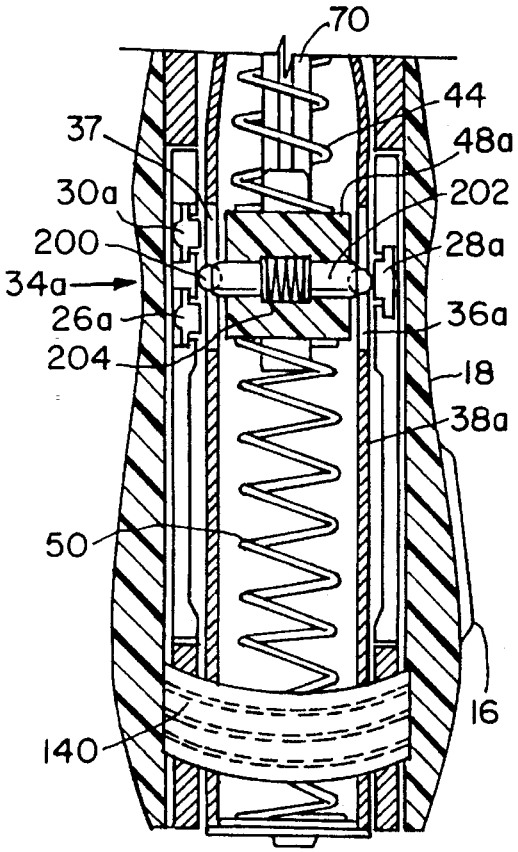
FIG. 36 is a cross-sectional view of a handle of a firearm showing a dual element actuator.

Although actuator 34 has been shown as a single ended actuator only, this is not a necessary limitation of the invention as actuator 34*a*, FIG. 36, may include one actuator element 200, 202 at each end at slots 36*a*, 37 with a biasing spring 204 between them. This provides two advantages. First, it enables switches 26*a* and 30*a* to be put on one side of magazine 38*a* and the middle switch 28*a* to be put on the other so that the switches can all be packed much more closely together. Further, it balances the forces between the magazine and the opposing walls of the magazine chamber so that magazine 38*a* will remain better centered and will free-fall more readily when released.

Figure 37:
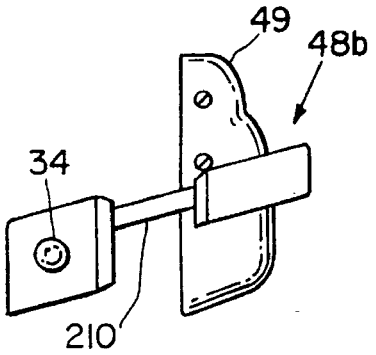
FIG. 37 is a side elevational view of an alternative follower mechanism intermediate element according to this invention.
Figure 39:
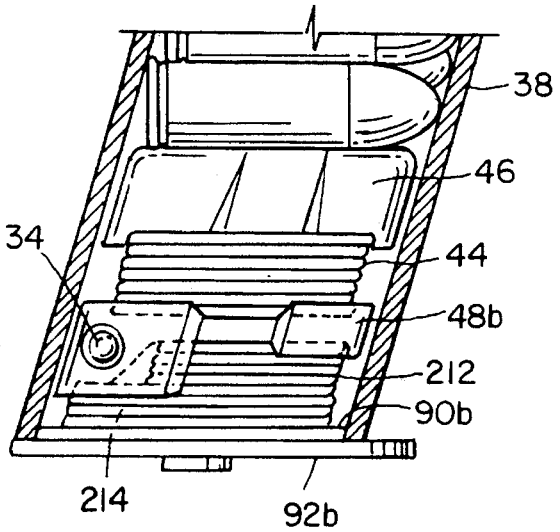
FIG. 39 is an enlarged detailed view of the follower mechanism of FIGS. 37 and compressed in a fully loaded magazine.
Figure 40:
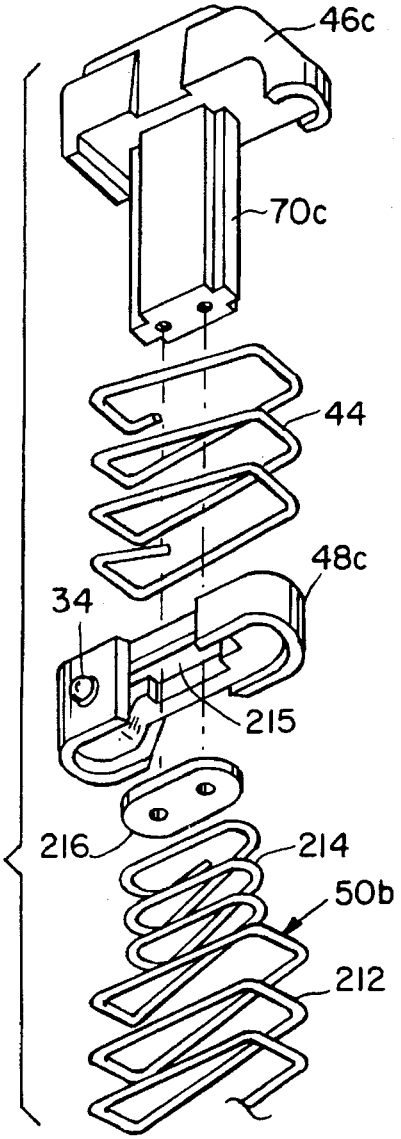
FIG. 40 is an exploded three-dimensional view of yet another follower mechanism according to this invention.

A smaller, more compact follower mechanism may be constructed using an intermediate dement 48*b*, FIG. 37, which has a narrower body 210 and thereby reduces the overall height or length of the follower mechanism. In this construction, lower spring 50*b* is formed in two sections: an upper section 212 and lower section 214, FIG,. 38. Upper section 212 is of a reduced diameter so that it can nest farther up in the body of narrower profile intermediate dement 48*b*, FIG. 39, leaving enough room at one end for the larger portion needed to house actuator 34, while at the same time the larger lower portion 214 is large enough to properly seat on the plate 90b of magazine base 92*b*. Since spring 44 is the strongest spring it expands first under full load of the magazine, spring section 214 expands next, and finally spring section 212 expands operating under the lightest load with only a few rounds left. The limiter may be implemented in another embodiment, FIG. 40, by a simple post 70*c* received in hole 215 of intermediate element 48*c* and limited in its movement by plate 216 which is mounted by screws, not shown, to the bottom of post 70*c*.

Figure 41:
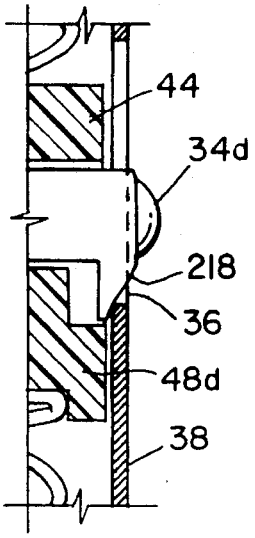
FIG. 41 is an enlarged detailed sectional view of an actuator having a camming surface to facilitate retraction of the actuator during loading of rounds into the magazine.
Figure 42:
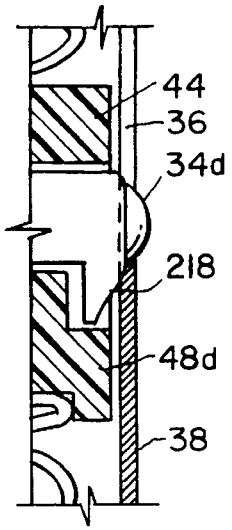
FIGS. 42 and 43 show the second and final steps in the retraction of the camming actuator of FIG. 41.
Figure 43:
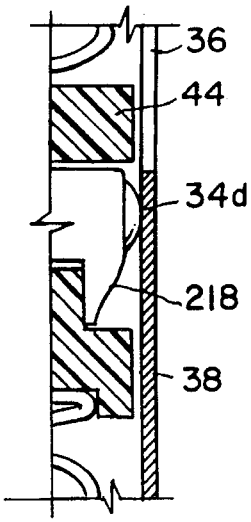

Another construction for facilitating the release of the magazine from the magazine chamber of the firearm is shown in FIG. 41 where actuator 34*d* includes a camming surface 218 that bears on slot 36 and causes actuator 34*d* to retract as intermediate follower member 48*d* moves downwardly in magazine 38 during the loading of the cartridges into the magazine. Its intermediate position is shown in FIG. 42 and its totally retracted position is illustrated in FIG. 43.

In an alternative construction, switch operators 28*e*, 30*e* and 32*e*, FIG. 44, may be simple stampings or injection moldings on plate 26*e*, which create cantilevered fingers such as illustrated by finger 28*e*, FIG. 45, which can easily be pressed downwardly in the direction of arrow 220 to cause protrusion 222 to bear on the top of layer 224, thereby pushing contact 226 into electrical engagement with contact 228. Although not shown, any type of switch can be substituted in place of a membrane switch to be operated in conjunction with the described actuator system of this invention.

For magazines which have a tapered upper portion such as magazine 38*f*, FIG. 46, an opening 36*f* may be provided for permitting switching device 24*f* to protrude into the body of magazine 38*f* where it will be contacted by actuator device 34*f*. The raised angled position of switch operator elements 28*f*, 30*f* and 32*f* is shown to advantage in FIG. 47.

A follower mechanism 42*g*, FIG. 48, which is even more compact can be made where the springs line up next to each other, spring 44*g* which extends intermediate element 48*g* which carries actuator 34*g* still between intermediate element 48*g* and follower element 46*g*, spring 50*g* is connected directly to follower dement 46*g* so that maximum use of the magazine capacity is not inhibited, as they compact side by side instead of on top of each other.

Figure 51:
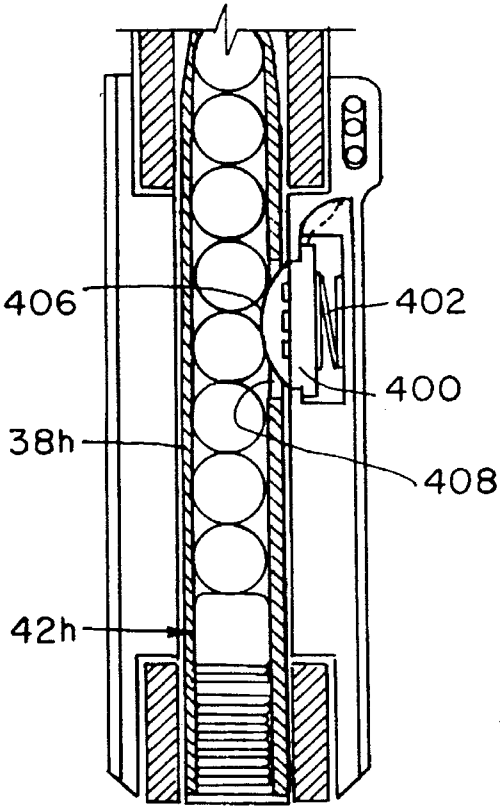
FIG. 51 is a view similar to FIGS. 49 and 50 with the magazine fully inserted and the switching device protruding into the magazine and contacting the rounds.
Figure 50:
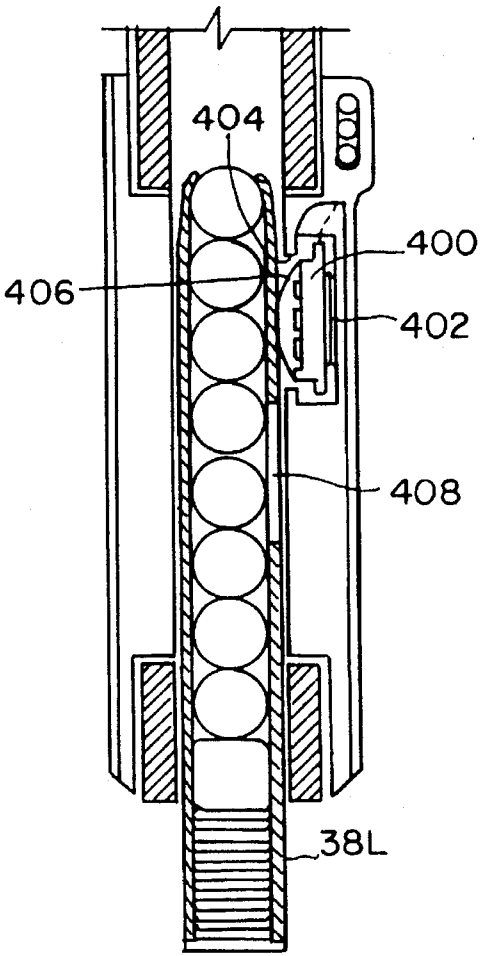
FIG. 50 is a view similar to FIG. 49 with the magazine further inserted and engaging the switching device.
Figure 49:
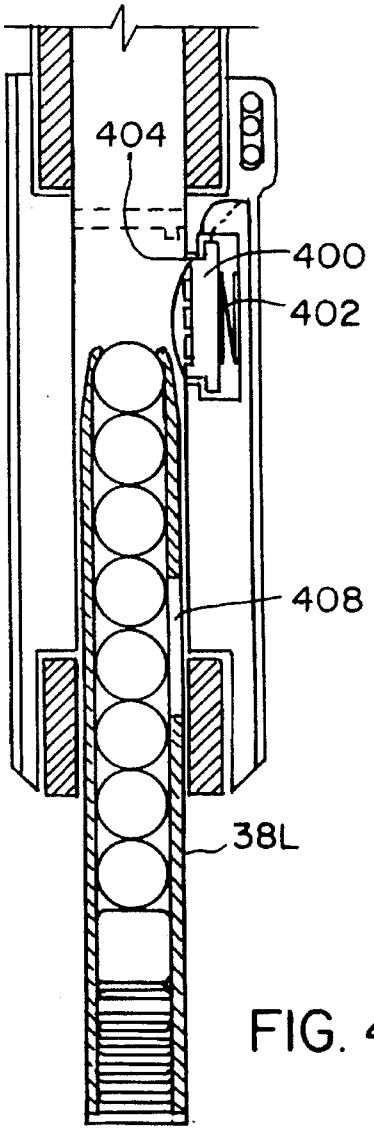
FIG. 49 is a schematic sectional view of the handle of a firearm showing an alternative spring loaded switching device with the magazine partially inserted but not engaging the switching device.
Figure 53:
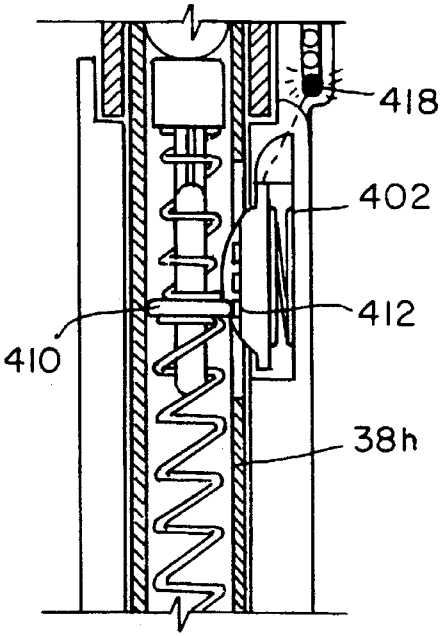
FIG. 53 is a view similar to FIG. 52 where the actuator has engaged the first of three switch elements indicating there are for example three cartridges left.
Figure 52:
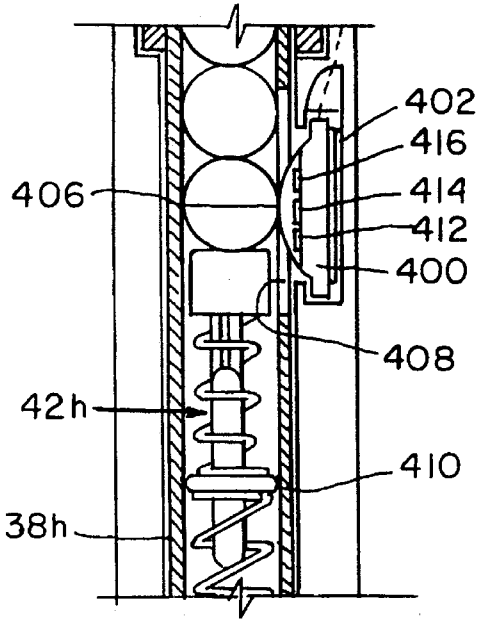
FIG. 52 is an enlarged detailed view of a portion of FIG. 51 before the actuator engages the switching device while there is still ample ammunition in the magazine.

In another configuration, the switching device may include a platform 400, FIG. 49, which is urged by spring 402 through hole 404 in the frame of a firearm. As magazine 38*h* with access hole 408 is inserted more fully, FIG. 50, the magazine pushes against camming surface 406 and drives platform 400 backward, collapsing spring 402, FIG. 50. When magazine 38*h* is fully seated, FIG. 51, platform 400 lines up with hole 408 in magazine 38*h*. Now, as the cartridges are expended and the follower mechanism 42*h* moves upwardly, actuator 410, FIG. 52, approaches access aperture 408, platform 400, and switches 412, 414 and 416, eventually, as shown in FIG. 53, actuator 410 engages the first of the switches 412 and lights an indicator light 418. Now, as the cartridges are stripped from the magazine 38h, FIGS. 51, 52, and the follower mechanism 42*h* moves upwardly, the camming surface 406 which is urged into the cartridges by spring 402, allows the cartridges to go freely by.

Figure 54:
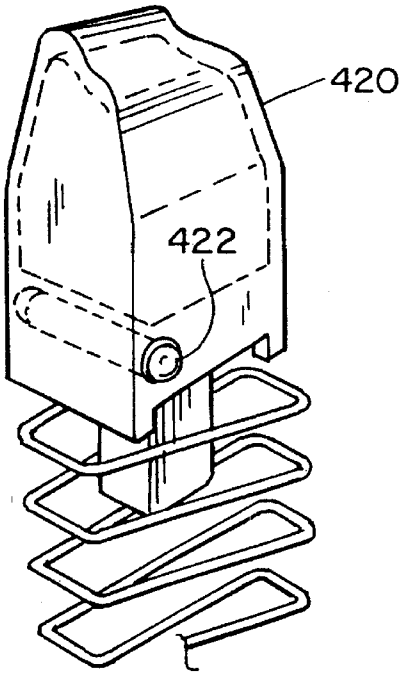
FIG. 54 is an enlarged detailed view of a portion of another follower mechanism according to this invention consisting of a single follower element with a double actuator mounted in it.

When the configuration of the gun frame is designed with an access aperture high enough to be compatible with a magazine aperture, the follower itself may carry the actuator 422 as shown in FIG. 54, where the follower 420 carries dual ended actuator 422.

Figure 55:
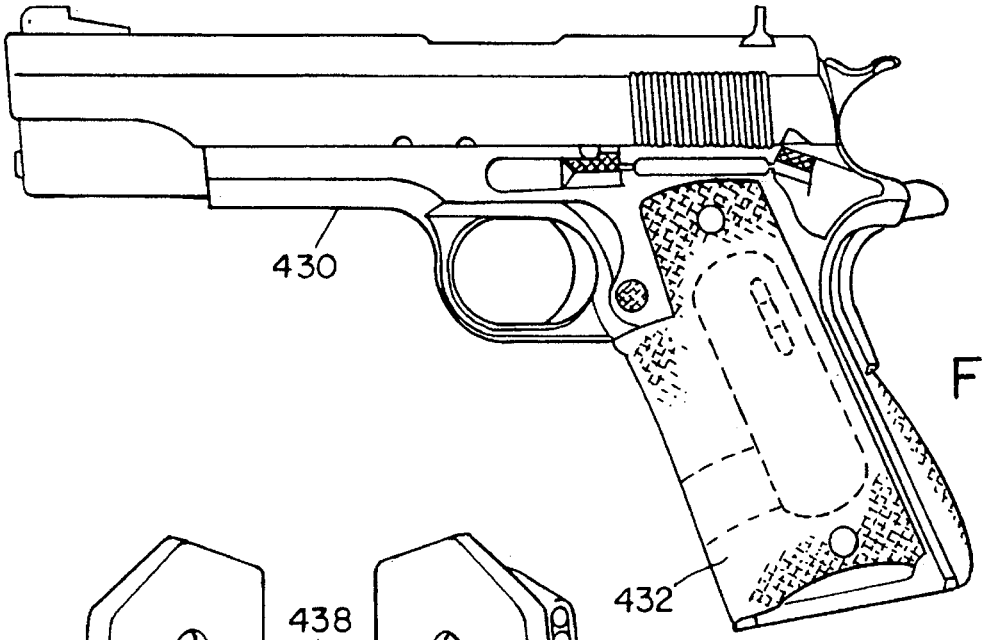
FIG. 55 is a side elevational view of a firearm showing two hand grips formed from a single piece which wraps around the front of the handle.
Figure 56:
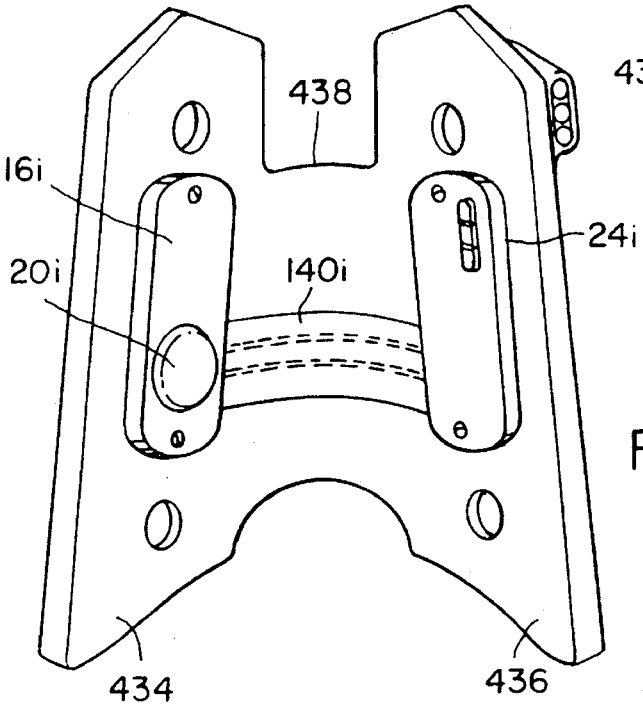
FIG. 56 is a three-dimensional view of the inside of the hand grip of FIG. 55 removed from the firearm assembly.

While thus far the interconnection between the circuitry in the opposite handle grips has been made through interconnection around the back of the firearm handle, this is not a necessary limitation of the invention. As shown in FIG. 55, the firearm 430 has an integral handle grip arrangement 432 in which the left 434 and right 436 handle grips are interconnected by member 438, FIG. 56, which wraps around the front of the firearm handle and carries membrane 140*i*. Note also in this configuration battery housing 16*i* is totally contained within the handle grips and does not protrude at all on the outside.

Figure 57:
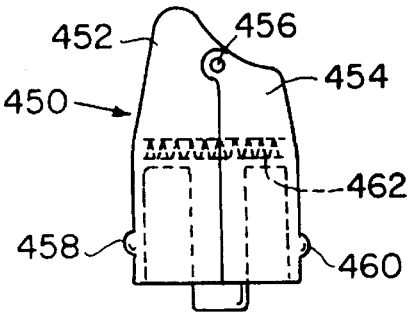
FIG. 57 is a side elevational view with portions shown in phantom of a split follower with double actuators according to this invention.
Figure 58:
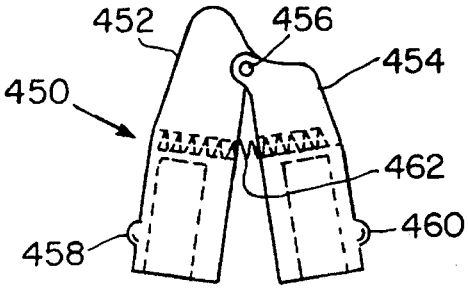
FIG. 58 is a view similar to FIG. 57 with the follower in the open condition whereby the actuators can operate a switching device.

The actuator and follower functions can be provided simultaneously by the same device as shown in FIG. 57, where follower 450 is split into two sections 452 and 454 rotatably connected at hinge 456. Each section 452 and 454 has an actuator detent 458 and 460. Thus when the slots are encountered in a magazine, spring 462 will urge apart sections 452 and 454, as shown in FIG. 58, causing actuator detents 458 and 460 to engage associated contacts.

Figure 59:
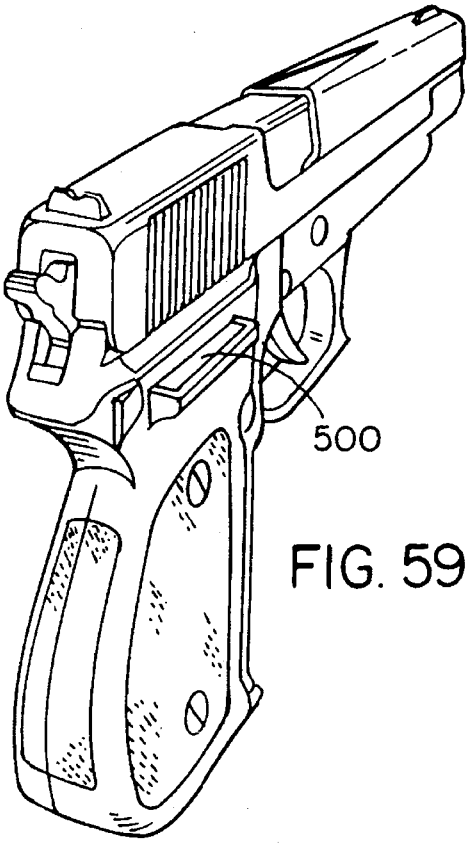
FIG. 59 is a right side perspective view of a firearm showing an alternative mechanical indicator device according to this invention.
Figure 60:
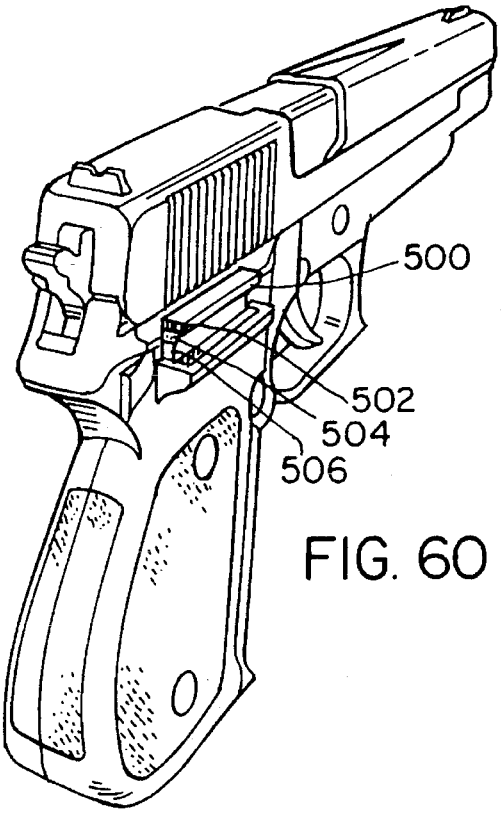
FIG. 60 is a view similar to FIG. 59 with the mechanical indicating device token in the alarm condition.
Figure 61:
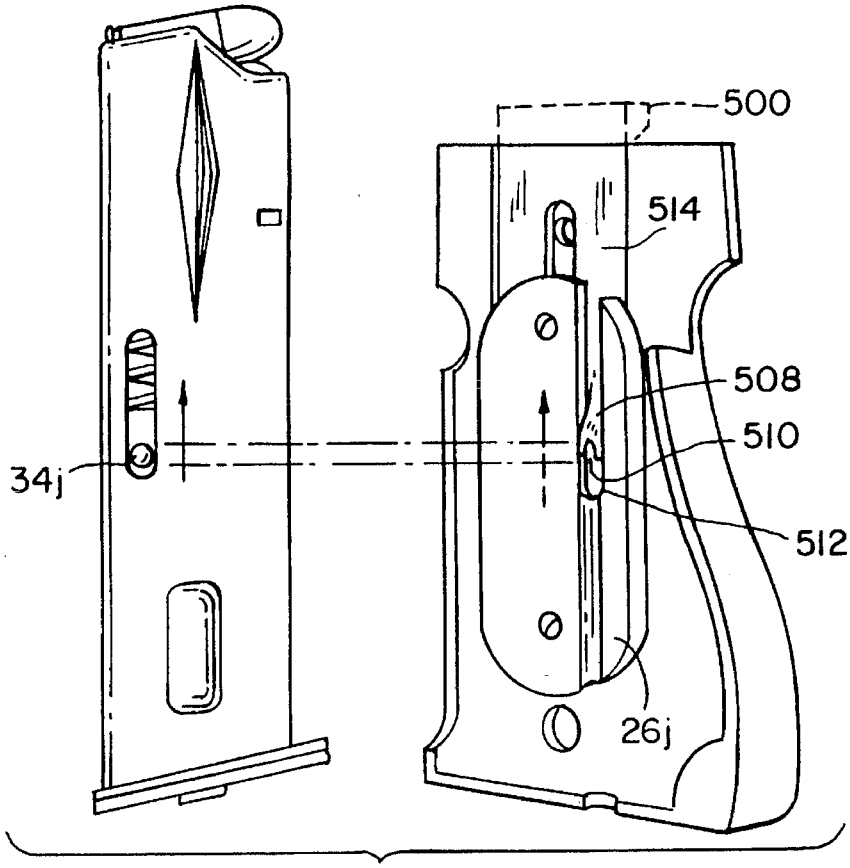
FIG. 61 is an axonometric view of a magazine and actuator and the mechanical monitoring device which operates with the mechanical indicator device of FIGS. 59 and 60.
Figure 62:
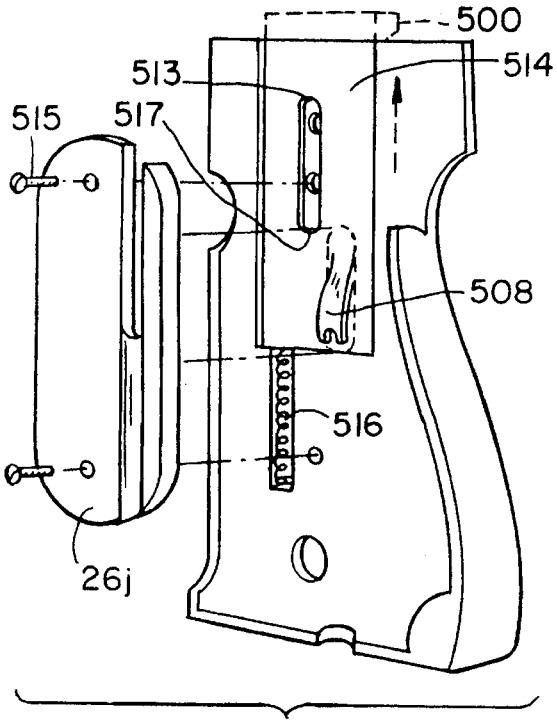
FIG. 62 is an exploded perspective view of the handle grip of FIG. 61 showing in more detail the parts of the mechanical monitoring and display device according to this invention.

Although thus far the automatic monitoring and indicator system according to this invention has been shown implemented electrically, this is not a necessary limitation of the invention. The indicator device may be a mechanical token 500, FIG. 59, which may begin to rise up in steps as the predetermined level of cartridges is reached. For example, the end of token 500, FIG. 60, could be a single color to indicate when no more cartridges are left, or it could be sectioned in three colors 502, 504, 506, which become visible selectively, serially as the cartridges are expended. Such a device in a typical actuator 34*j*, FIG. 61, would engage with a tongue 508, FIG. 61, which contains a groove 510 for receiving actuator 34*j*. Actuator 34*j* then lifts tongue 508. Tongue 508 moves up and down in slot 512 of plate 26*j*. Tongue 508 is a part of slider 514 at the top end of which is carried token 500. A return spring 516, FIG. 62, ensures that slider 514 and token 500 return to their retracted position when the magazine is withdrawn. Tongue 508 also allows the magazine to easily slide by for insertion and release. There is also a recess or slot 513 to accept slider 514. Screw 515 acts as a stop by engaging the lower end 517 of slot 513. Also tongue 508 can fall into the magazine to engage a slot or lifting element, not shown, to be driven upwards.

Figure 65:
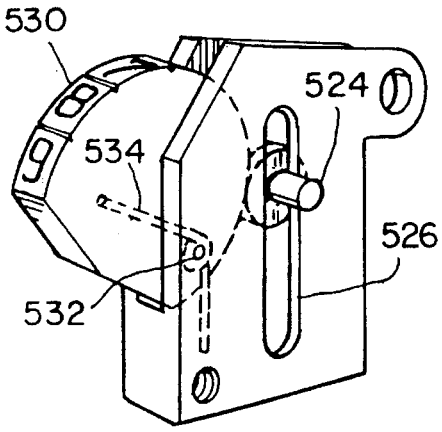
FIG. 65 is a view of the monitoring and indicator system of FIG. 64 in an alarm condition.
Figure 64:
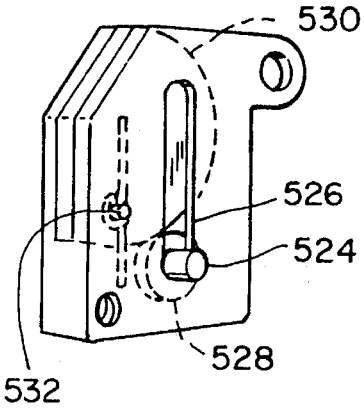
FIG. 64 is a three-dimensional view of the monitoring and indicator system of FIG. 63.
Figure 63:
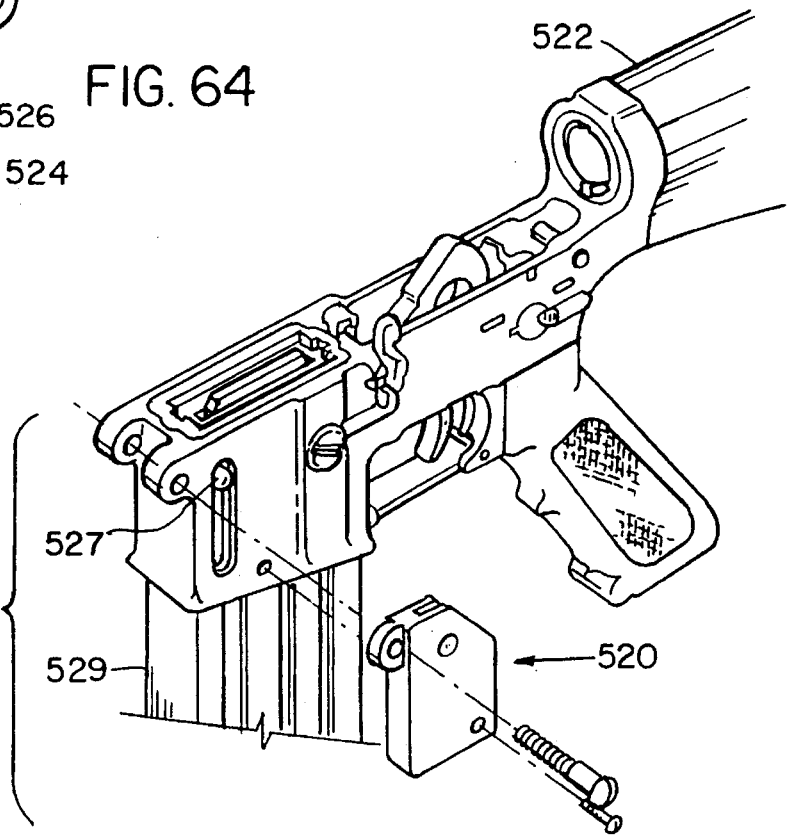
FIG. 63 is a left side perspective view of a rifle employing another form of mechanical monitoring and indicator system according to this invention.

Another mechanical implementation of the monitoring and indicator system 520 according to this invention is shown in FIG. 63 mounted to a rifle 522. System 520 includes slider 524, FIG. 64, mounted through slot 526. Slider 524 has an enlarged flange 528 which bears on token 530 rotatably mounted for rotation about pivot 532. As slider 524 is driven upwardly, FIG. 65, in slot 526 by actuator 527 of magazine 529, FIG. 63, it causes token 530 to rotate outwardly displaying numbers which indicate the number of cartridges spent or remaining. The return spring 534 returns token 530 and slider 524 to the start position when the magazine is removed from the magazine receiver in rifle 522.

Figure 66:
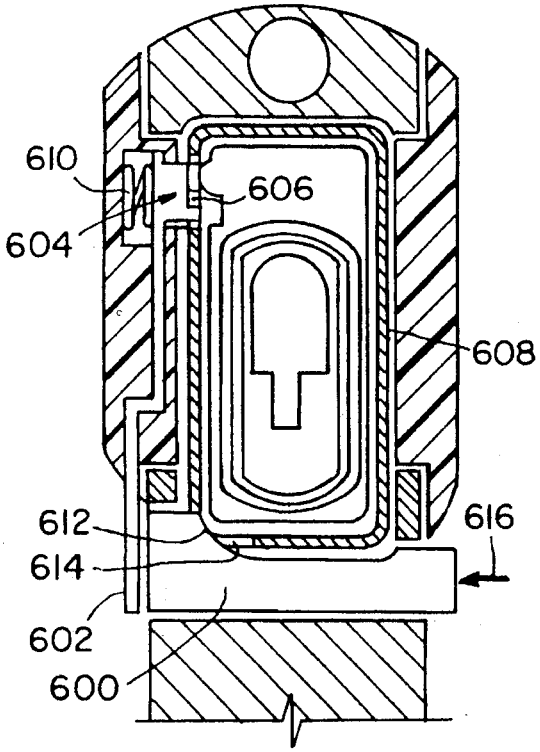
FIG. 66 is a top sectional view of a retractor mechanism for a switching device operable in conjunction with the magazine release.
Figure 67:
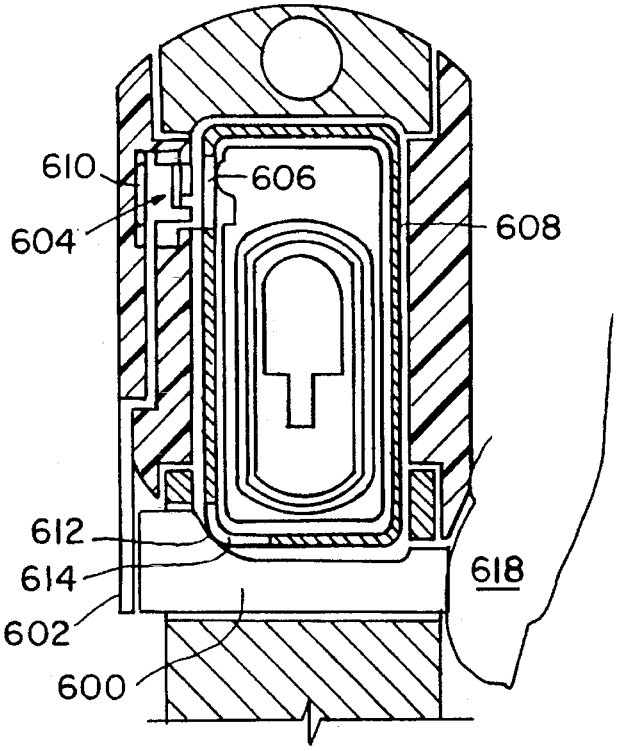
FIG. 67 is a view similar to FIG. 66 with the switching device retracted by operation of the magazine release.

A combination magazine release and switching device retractor is shown in FIG. 66, where magazine release 600 contacts switch extension 602 of switching device 604 urged outwardly through hole 606 in magazine 608 by spring 610. When the magazine 608 is locked in the magazine chamber, a shoulder 612 of release 600 is nested in opening 614 in the comer of magazine 608. However, when release 600 is pushed in the direction of arrow 616 by finger 618, FIG. 67, release 600 not only removes shoulder 612 from opening 614, thereby releasing magazine 608, it also drives switch extension 602 to the left, compressing spring 610 and withdrawing switching device 604 from access hole 606, thereby permitting the magazine to free-fall quickly and easily.

Figure 68:
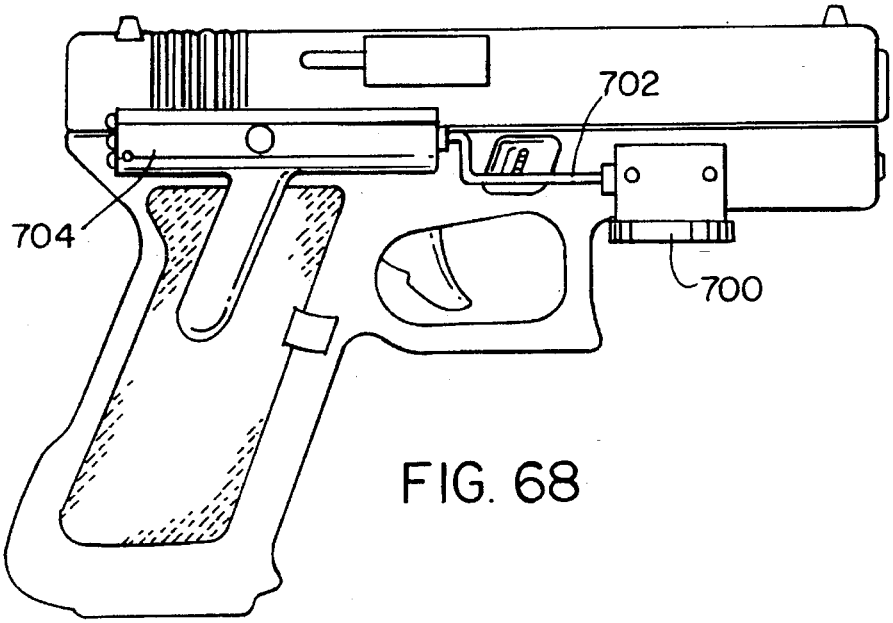
FIG. 68 is a side sectional elevational view of a firearm specially modified to accept the monitoring and indicator system according to this invention.

Although thus far the monitoring and indicator system according to this invention has been illustrated as adapted for retrofitting to existing firearms, this is not a necessary limitation of the invention: it can be even more easily adapted to original equipment designed to accept it initially as in FIG. 68, where for example the battery has been shown housed within the frame of the firearm, typically within the handle grips. In one variation the battery may be placed in a housing 700, interconnected by cable 702 to housing 704 which contains both the indicator device and monitoring device.

Although not shown, this invention is also adaptable to any tubular type magazine firearm, as they too have a spring for driving a follower to feed cartridges into a chamber.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. An automatic cartridge monitoring and indicator system for a firearm having a cartridge chamber comprising:

a magazine for storing a plurality of cartridges;

a follower mechanism in said magazine for feeding said cartridges from said magazine into the firearm; said follower mechanism includes a follower element, an intermediate element spaced from said follower element, a first spring device between said elements and a second spring device engaged with the side of said intermediate element opposite said first spring device; said first spring device opens before said second spring device and remains open while said second spring device opens;

an actuator moveable with said follower mechanism;

monitoring means disposed along the path of said follower mechanism and operable by said actuator for monitoring the level of said follower mechanism and the level of cartridges in said magazine and in said chamber; and an indicator device, responsive to said monitoring means, for providing a representation of the level of cartridges in the magazine and in said chamber.

2. The automatic cartridge monitoring and indicator system of claim 1 in which said monitoring device includes a slider and said indicator device includes a token driven by said slider.

3. The automatic cartridge monitoring and indicator system of claim 2 in which said monitoring device includes biasing means for resetting said slider and retracting said token when said magazine is removed.

4. The automatic cartridge monitoring and indicator system of claim 2 in which the firearm includes handle grips and at least one of said grips houses at least a portion of said monitoring device.

5. The automatic cartridge monitoring and indicator system of claim 2 in which said grip houses said slider and said token.

6. An automatic cartridge monitoring and indicator system for a firearm comprising:

a magazine for storing a plurality of cartridges;

a follower mechanism in said magazine for feeding said cartridges from said magazine into the firearm;

an actuator moveable with said follower mechanism;

a monitoring device disposed along the path of said follower mechanism and operable by said actuator to monitor the level of said follower mechanism and the level of cartridges in said magazine; and an indicator device, responsive to said monitoring device, for providing a representation of the level of cartridges in said magazine;

said actuator is spring loaded and the firearm includes handle grips and one of said handle grips includes a recess for accommodating extension of said actuator protruding from said magazine for permitting the magazine to move freely in the firearm and a camming surface at the end of the recess for gradually compressing said actuator to facilitate removal of said magazine from said firearm.

7. An automatic cartridge monitoring and indicator system for a firearm comprising:

a magazine for storing a plurality of cartridges;

a follower mechanism in said magazine for feeding said cartridges from said magazine into the firearm;

an actuator moveable with said follower mechanism;

an electrical monitoring circuit including a switching device mounted on the firearm disposed along the path of said follower mechanism and operable by said actuator to monitor the level of said follower mechanism and the level of the cartridges in said magazine; said actuator protruding through an aperture from said magazine to engage said switching device; and an indicator device, responsive to said monitoring device, for providing a representation of the level of cartridges in said magazine.

8. The automatic cartridge monitoring and indicator system of claim 7 in which said switching device includes at least one switch.

9. The automatic cartridge monitoring and indicator system of claim 7 in which said switching device includes a plurality of switches.

10. The automatic cartridge monitoring and indicator system of claim 7 in which said switching device is mounted on the firearm.

11. The automatic cartridge monitoring and indicator system of claim 7 in which said magazine is a box magazine.

12. The automatic cartridge monitoring and indicator system of claim 10 in which said magazine includes a recess and said switching device protrudes into said magazine to engage said actuator.

13. The automatic cartridge monitoring and indicator system of claim 7 in which said indicator device provides a representation of the number of cartridges remaining in said magazine.

14. The automatic cartridge monitoring and indicator system of claim 7 in which said indicator device provides a representation of the total number of cartridges remaining in said magazine and chamber of the firearm.

15. The automatic cartridge monitoring and indicator system of claim 7 in which said indicator device provides a representation that the last cartridge is in the chamber and the magazine is empty.

16. The automatic cartridge monitoring and indicator system of claim 7 in which said indicator device provides a representation of the number of cartridges expended from said magazine and of a malfunction.

17. The automatic cartridge monitoring and indicator system of claim 7 in which the representation provided by said indicator device includes a visual display.

18. The automatic cartridge monitoring and indicator system of claim 17 in which said visual display includes at least one light.

19. The automatic cartridge monitoring and indicator system of claim 17 in which said visual display includes an alphanumeric readout.

20. The automatic cartridge monitoring and indicator system of claim 18 in which said light is energized when there is but one cartridge remaining in the chamber of the firearm.

21. The automatic cartridge monitoring and indicator system of claim 18 in which said visual display includes two lights, the first of which is energized when there is one cartridge left in the chamber of the firearm and the second of which is energized where there is one cartridge in the chamber and one cartridge left in the magazine.

22. The automatic cartridge monitoring and indicator system of claim 21 in which said first light is red and said second light is yellow.

23. The automatic cartridge monitoring and indicator system of claim 18 in which said visual display includes three lights, the first of which is energized when there is one cartridge left in the chamber of the firearm, the second of which is energized where there is one cartridge in the chamber and one cartridge left in the magazine, and the third of which is energized when there is one cartridge in the chamber and two cartridges left in the magazine.

24. The automatic cartridge monitoring and indicator system of claim 23 in which said first light is red, said second light is yellow, and said third light is green.

25. The automatic cartridge monitoring and indicator system of claims 18, 21, or 23 in which said first light remains energized after the last cartridge has been fired.

26. The automatic cartridge monitoring and indicator system of claim 18 in which said monitoring circuit includes an adjustment device for setting the brightness of said at least one light.

27. The automatic cartridge monitoring and indicator system of claim 18 further including means for sensing ambient light levels and sets the brightness of said at least one light as a function of the ambient light.

28. The automatic cartridge monitoring and indicator system of claim 18 in which said at least one light includes an LED.

29. The automatic cartridge monitoring and indicator system of claim 7 in which said follower mechanism includes a follower element and a spring device for urging said follower element to feed the cartridges to said firearm.

30. The automatic cartridge monitoring and indicator system of claim 29 in which said actuator is mounted for movement with said follower element.

31. The automatic cartridge monitoring and indicator system of claim 7 in which said follower mechanism includes a follower element, an intermediate element spaced from said follower element, a first spring device between said elements and a second spring device engaged with the side of said intermediate element opposite said first spring device.

32. The automatic cartridge monitoring and indicator system of claim 31 in which said first spring device opens before said second spring device and remains open while said second spring device opens.

33. The automatic cartridge monitoring and indicator system of claim 31 in which said follower mechanism includes a limiter device interconnecting said elements to define the distance by which said elements can be separated by said first spring device.

34. The automatic cartridge monitoring and indicator system of claim 31 in which said actuator is mounted for movement with said intermediate element.

35. The automatic cartridge monitoring and indicator system of claim 31 in which said second spring device includes two spring sections, an upper and a lower section, said upper section being smaller in diameter than said lower section.

36. The automatic cartridge monitoring and indicator system of claim 7 in which said firearm includes two handle grips and at least one of said grips includes a housing for holding at least a portion of said monitoring circuit.

37. The automatic cartridge monitoring and indicator system of claim 36 in which said monitoring circuit includes a power source and said power source is in said housing.

38. The automatic cartridge monitoring and indicator system of claim 37 in which said power source includes a battery.

39. The automatic cartridge monitoring and indicator system of claim 38 in which said battery is mounted internally on a handle grip and extends into an aperture existing on the firearm frame.

40. The automatic cartridge monitoring and indicator system of claim 7 in which said indicator device is mounted on the firearm.

41. The automatic cartridge monitoring and indicator system of claim 7 in which the firearm includes handle grips and said indicator device is fixed to one of said grips.

42. The automatic cartridge monitoring and indicator system of claim 41 in which said display device is contained in a mounting box and said one of said grips includes a recess for receiving said mounting box.

43. The automatic cartridge monitoring and indicator system of claim 42 in which said mounting box is sized for an interference fit with said recess.

44. The automatic cartridge monitoring and indicator system of claim 7 in which said monitoring circuit is always enabled and operates automatically upon the level of cartridges reaching a predetermined level.

45. The automatic cartridge monitoring and indicator system of claim 7 in which said monitoring circuit includes a test switch for energizing said indicator device to demonstrate its operability.

46. The automatic cartridge monitoring and indicator system of claim 7 in which said switching device includes at least one switch element and one operator element responsive to said actuator for operating said switch element.

47. The automatic cartridge monitoring and indicator system of claim 46 in which said switch element includes a membrane switch.

48. The automatic cartridge monitoring and indicator system of claim 47 in which the firearm has handle grips and said membrane switch is mounted in an internal recess in one of said grips.

49. The automatic cartridge monitoring and indicator system of claim 48 in which said operator element is mounted on the inside of said grip, said firearm has a handle, and said operator element extends through an aperture in the handle of the firearm.

50. The automatic cartridge monitoring and indicator system of claim 7 in which said switching device includes a membrane switch and the firearm includes an aperture for permitting said actuator to engage said membrane switch.

51. The automatic cartridge monitoring and indicator system of claim 7 in which said firearm includes handle grips, said monitor circuit includes a power source in one of said grips and said switching device in the other of said grips and said power source and said switching device are electronically interconnected by a first flat ribbon conductor disposed within the existing grips.

52. The automatic cartridge monitoring and indicator system of claim 51 in which said power source is housed within a second flat ribbon conductor interconnected with said first flat ribbon conductor.

53. The automatic cartridge monitoring and indicator system of claim 7 in which said switching device includes at least one switch element responsive to said actuator.

54. The automatic cartridge monitoring and indicator system of claim 53 in which said switch element includes a membrane switch.

55. The automatic cartridge monitoring and indicator system of claim 7 in which said actuator is spring loaded and the firearm includes handle grips and one of said handle grips includes a recess for accommodating extension of said actuator protruding from said magazine for permitting the magazine to move freely in the firearm and a camming surface at the end of the recess for gradually compressing said actuator to facilitate removal of said magazine from said firearm.

56. The automatic cartridge monitoring and indicator system of claim 7 in which said actuator has an actuator element extending from each side of said magazine.

57. The automatic cartridge monitoring and indicator system of claim 56 in which said monitoring device includes a switching device which includes at least one switch element associated with each side of said magazine for operation by an associated one of said actuator elements.

58. The automatic cartridge monitoring and indicator system of claim 56 in which said actuator elements are spring loaded and the firearm includes two handle grips, each of said handle grips includes a recess for accommodating extension of the associated said actuator element protruding from said magazine for permitting the magazine to move freely, centrally, longitudinally in the firearm and a camming surface at the end of each recess for gradually compressing said actuator elements to facilitate removal of said magazine from the firearm.

59. The automatic cartridge monitoring and indicator system of claim 7 in which said switching device includes at least one switch element, each switch element includes a pair of spaced conductors and said actuator includes a conductive contact for bridging said spaced conductors and electrically connecting them to actuate said indicator device.

60. The automatic cartridge monitoring and indicator system of claim 7 in which said firearm includes handle grips, said monitor circuit includes a power source in one of said grips and said switching device in the other of said grips and said power source and said switching device are electronically interconnected by conductors in each of said grips and connection pins in one grip that engage sockets in the other.

61. The automatic cartridge monitoring and indicator system of claim 7 further including a remote data connector responsive to said monitoring means for providing a representation of the condition of the firearm to a remote device.

62. The automatic cartridge monitoring and indicator system of claim 7 in which said actuator includes a spring loaded actuator element and said actuator element includes a cam surface to guide it back into said magazine to facilitate easy loading of cartridges into said magazine.

63. The automatic cartridge monitoring and indicator system of claim 7 in which said follower mechanism includes a follower element and an intermediate element spaced from said follower element, a first spring device between said elements and a second spring device engaged with the side of said follower element facing said intermediate element.

64. The automatic cartridge monitoring and indicator system of claim 7 in which said firearm includes a magazine release mechanism, said switching device is biased to enter an aperture in said magazine to engage said actuator, and said switching device includes an interconnection device responsive to said release mechanism for overcoming the bias and retracting said switching device from said magazine aperture simultaneously with the operation of said release enable said magazine to freely fall from the firearm.

65. The automatic cartridge monitoring and indicator system of claim 7 in which the magazine and switching device are in the frame of the firearm.

66. The automatic cartridge monitoring and indicator system of claim 65 in which the firearm is a pistol.

67. The automatic cartridge monitoring and indicator system of claim 7 in which the magazine is mounted in a magazine receiver and the switching device is mounted on the outside of the receiver through an aperture.

68. The automatic cartridge monitoring and indicator system of claim 67 in which the firearm is a rifle.

69. The automatic cartridge monitoring and indicator system of claim 7 in which said follower mechanism includes two interconnected sections movable relative to each other, said actuator includes at least one actuator element on at least one of said sections and biasing means for urging apart said sections and urging said actuator element to engage said switching device.

70. The automatic cartridge monitoring and indicator system of claim 7 in which the firearm includes two handle grips which are integrally formed as a single unit.

71. An automatic cartridge monitoring and indicator system for a firearm comprising:

a magazine for storing a plurality of cartridges;

a follower mechanism in said magazine for feeding said cartridges from said magazine into the firearm;

an actuator moveable with said follower mechanism;

a electrical monitoring circuit including a switching device disposed along the path of said follower mechanism and operable by said actuator to monitor the level of said follower mechanism and the level of cartridges in said magazine; and an indicator device, responsive to said monitoring device, for providing a representation of the level of cartridges in said magazine;

said firearm including handle grips, said monitor circuit including a power source in one of said grips and said switching device in the other of said grips and said power source and said switching device are electrically interconnected by a first flat ribbon conductor disposed within the existing grips.

72. The automatic cartridge monitoring and indicator system of claim 71 in which said power source is housed within a second flat ribbon conductor interconnected with said first flat ribbon conductor.

73. An automatic cartridge monitoring and indicator system for a firearm comprising:

a magazine for storing a plurality of cartridges;

a follower mechanism in said magazine for feeding said cartridges from said magazine into the firearm;

an actuator moveable with said follower mechanism; an electrical monitoring device including a switching device disposed along the path of said follower mechanism and operable by said actuator to monitor the level of said follower mechanism and the level of cartridges in said magazine; and an indicator device, responsive to said monitoring device, for providing a representation of the level of cartridges in said magazine;

said switching device including at least one switch element having a membrane switch and one operator element responsive to said actuator for operating said switch element;

said firearm having handle grips and said membrane switch being mounted in an internal recess in one of said grips; and said operator element being mounted on the inside of a said grip, said firearm having a handle, and said operator element extending through an aperture in the handle of the firearm.

74. An automatic cartridge monitoring and indicator system for a firearm having a cartridge chamber comprising:

a magazine for storing a plurality of cartridges;

a follower mechanism in the magazine for feeding said cartridges from said magazine into the firearm; said follower mechanism includes a follower element, a intermediate element spaced from said follower element, a first spring device between said elements and a second spring device engaged with the side of said intermediate element opposite said first spring device; said follower mechanism including a limiter device interconnecting said elements to define the distance by which said elements can be separated by said first spring device;

an actuator moveable with said follower mechanism;

monitoring means disposed along the path of said follower mechanism and operable by said actuator for monitoring the level of said follower mechanism and the level of cartridges in said magazine and in said chamber; and an indicator device, responsive to said monitoring means, for providing a representation of the level of cartridges in the magazine and in said chamber.

75. An automatic cartridge monitoring and indicator system for a firearm having a cartridge chamber comprising:

a magazine for storing a plurality of cartridges;

a follower mechanism in said magazine for feeding said cartridges from said magazine into the firearm; said follower mechanism includes a follower element, an intermediate element spaced from said follower element, a first spring device between said elements and a second spring device engaged with the side of said intermediate element opposite said first spring device;

an actuator mounted on said intermediate element of said follower mechanism;

monitoring means disposed along the path of said follower mechanism and operable by said actuator for monitoring the level of the intermediate element and the level of cartridges in said magazine and in said chamber; and an indicator device, responsive to said monitoring means, for providing a representation of the level of cartridges in the magazine and in said chamber.

* * * * *